US007946804B2

(12) United States Patent
Yoshida

(10) Patent No.: US 7,946,804 B2
(45) Date of Patent: May 24, 2011

(54) AXIAL FAN UNIT HAVING REDUCED NOISE GENERATION

(75) Inventor: Yusuke Yoshida, Kyoto (JP)

(73) Assignee: Nidec Corporation, Kyoto (JP)

( * ) Notice: Subject to any disclaimer, the term of this patent is extended or adjusted under 35 U.S.C. 154(b) by 966 days.

(21) Appl. No.: 11/831,274

(22) Filed: Jul. 31, 2007

(65) Prior Publication Data

US 2008/0031723 A1 Feb. 7, 2008

(30) Foreign Application Priority Data

Aug. 2, 2006 (JP) ..... 2006-210494

(51) Int. Cl.
*F04D 25/16* (2006.01)
*F04D 29/54* (2006.01)
*F04D 19/00* (2006.01)

(52) U.S. Cl. ..... 415/60; 415/199.5; 415/211.2; 415/220

(58) Field of Classification Search ..... 415/119, 415/61, 68, 69, 199.4, 199.5, 199.6, 208.2, 415/209.1, 211.2, 220; 416/120, 198 R, 416/238

See application file for complete search history.

(56) References Cited

U.S. PATENT DOCUMENTS

| | | | | |
|---|---|---|---|---|
| 3,088,414 | A * | 5/1963 | Cahit | 415/68 |
| 7,156,611 | B2 | 1/2007 | Oosawa et al. | |
| 7,344,358 | B2 * | 3/2008 | Lu et al. | 415/211.2 |
| 2005/0226719 | A1 * | 10/2005 | Sun | 415/193 |
| 2006/0045736 | A1 | 3/2006 | Lee et al. | |
| 2006/0045738 | A1 * | 3/2006 | Lee et al. | 415/220 |
| 2006/0083608 | A1 | 4/2006 | Sun | |

FOREIGN PATENT DOCUMENTS

| | | | |
|---|---|---|---|
| JP | 3121296 | A * | 5/1991 |
| JP | 08-028491 | A | 1/1996 |

OTHER PUBLICATIONS

Official communication issued in counterpart Chinese Application No. 200710139846.3, issued on Jan. 23, 2009.

* cited by examiner

*Primary Examiner* — Ninh H Nguyen
*Assistant Examiner* — Jesse Prager
(74) *Attorney, Agent, or Firm* — Keating & Bennett, LLP

(57) ABSTRACT

An axial fan unit includes two or more impellers accommodated in a housing. Each impeller has a plurality of blades disposed about a center axis and is rotated by an associated motor. The rotation of the impellers creates a flow of air generally flowing along the center axis. A plurality of ribs are disposed between the impellers and connected to the housing. The ribs support an associated motor. At least one of an air-inlet side edge and an air-outlet side edge of each rib is inclined with respect to a direction that is perpendicular or substantially perpendicular to the center axis, such that it gets closer to one of an air-inlet side end and an air-outlet side end of the axial fan unit as it moves away from the center axis.

25 Claims, 15 Drawing Sheets

AXIAL FAN UNIT HAVING REDUCED NOISE GENERATION

BACKGROUND OF THE INVENTION

1. Field of the Invention

The present invention relates to an axial fan unit including two or more coaxially arranged fans.

2. Description of the Related Art

Electronic devices having frames such as personal computers and servers include cooling fans therein. The cooling fans are used for cooling electronic components inside the frames. When density of the electronic components inside the frames increases, concentration of heat generated by the electronic components occurs and lowers performances of the electronic components. In order to prevent this, cooling fans are required to have improved performances.

Among various types of electronic devices, relatively large sized electronic devices such as servers require cooling fans which can achieve both a high static pressure and a large flow rate of air. One example of such cooling fans is an axial fan unit formed by at least two fans connected coaxially with each other. In each of the fans coaxially connected to each other, a plurality of supporting legs for securing an armature to a frame of the axial fan unit and stator vanes attached to the supporting legs are disposed on a downstream side of an impeller in an air flowing direction, i.e., in a direction parallel to or substantially parallel to a center axis of the axial fan unit. That is, the supporting legs and the stator vanes are disposed on an air-outlet side of the impeller in each fan. The supporting legs and the stator vanes extend in a radial direction perpendicular to the center axis.

For cooling fans installed in electronic devices, reducing or minimized noises or operation sounds of the cooling fans are demanded from a viewpoint of improving operation environments where the electronic devices are to be used, for example. However, in the aforementioned exemplary axial fan unit, air sent by each impeller interferes with the supporting legs and stator vanes disposed on the air-outlet side of that impeller, thus increasing noises of the axial fan unit.

SUMMARY OF THE INVENTION

According to preferred embodiments of the present invention, an axial fan unit includes: a first impeller having a plurality of first blades which are disposed about a center axis; a first motor operable to rotate the first impeller about the center axis to create a first flow of air generally flowing along the center axis; a second impeller adjacent to the first impeller and having a plurality of second blades disposed about the center axis; a second motor operable to rotate the second impeller about the center axis to create a second flow of air flowing generally in a direction of the first flow of air; a housing surrounding the first impeller and the second impeller; and a plurality of ribs disposed between the first impeller and the second impeller and connected at least to the housing and the first motor. First impeller side edges of the ribs are inclined with respect to a radial direction that is perpendicular or substantially perpendicular to the center axis.

According to another preferred embodiment of the present invention, an axial fan includes: a first impeller having a plurality of first blades disposed about a center axis; a first motor operable to rotate the first impeller about the center axis to create a first flow of air generally flowing along the center axis; a second impeller adjacent to the first impeller along the center axis and having a plurality of second blades disposed about the center axis; a second motor operable to rotate the second impeller about the center axis to create a second flow of air generally flowing in the same direction as the first flow; a housing surrounding the first and second impellers; and a plurality of ribs disposed about the center axis between the first and second impellers and connected at least to the housing and the first motor. In the axial fan unit, each of second-impeller side edges of the first blades includes an inclined portion which is inclined with respect to a radial direction that is perpendicular or substantially perpendicular to the center axis. First-impeller side edges of the ribs extend along an envelope obtained by turning the second-impeller side edges of the first blades about the center axis with a gap maintained between the first-impeller side edges of the ribs and the envelope.

Other features, elements, advantages and characteristics of the present invention will become more apparent from the following detailed description of preferred embodiments thereof with reference to the attached drawings.

DETAILED DESCRIPTION OF PREFERRED EMBODIMENTS

Figure 1:
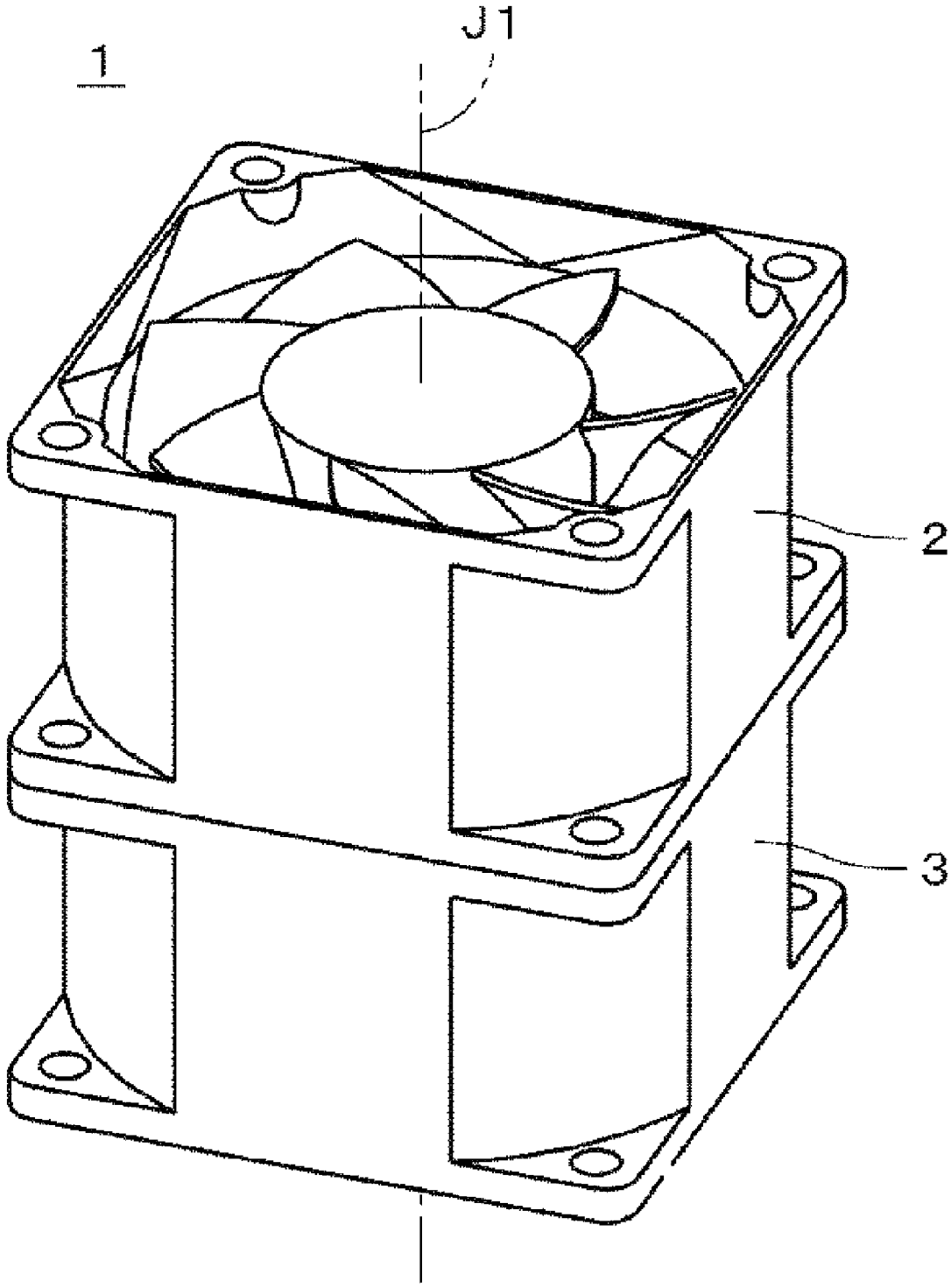
FIG. 1 is a perspective view of an axial fan unit according to a first preferred embodiment of the present invention.

Referring to FIGS. 1 through 15, preferred embodiments of the present invention will be described in detail. It should be noted that in the explanation of the present invention, when positional relationships among and orientations of the different components are described as being up/down or left/right, ultimately positional relationships and orientations that are in the drawings are indicated; positional relationships among and orientations of the components once having been assembled into an actual device are not indicated. Meanwhile, in the following description, an axial direction indicates a direction parallel to a rotation axis, and a radial direction indicates a direction perpendicular to the rotation axis.

First Preferred Embodiment

Figure 2:
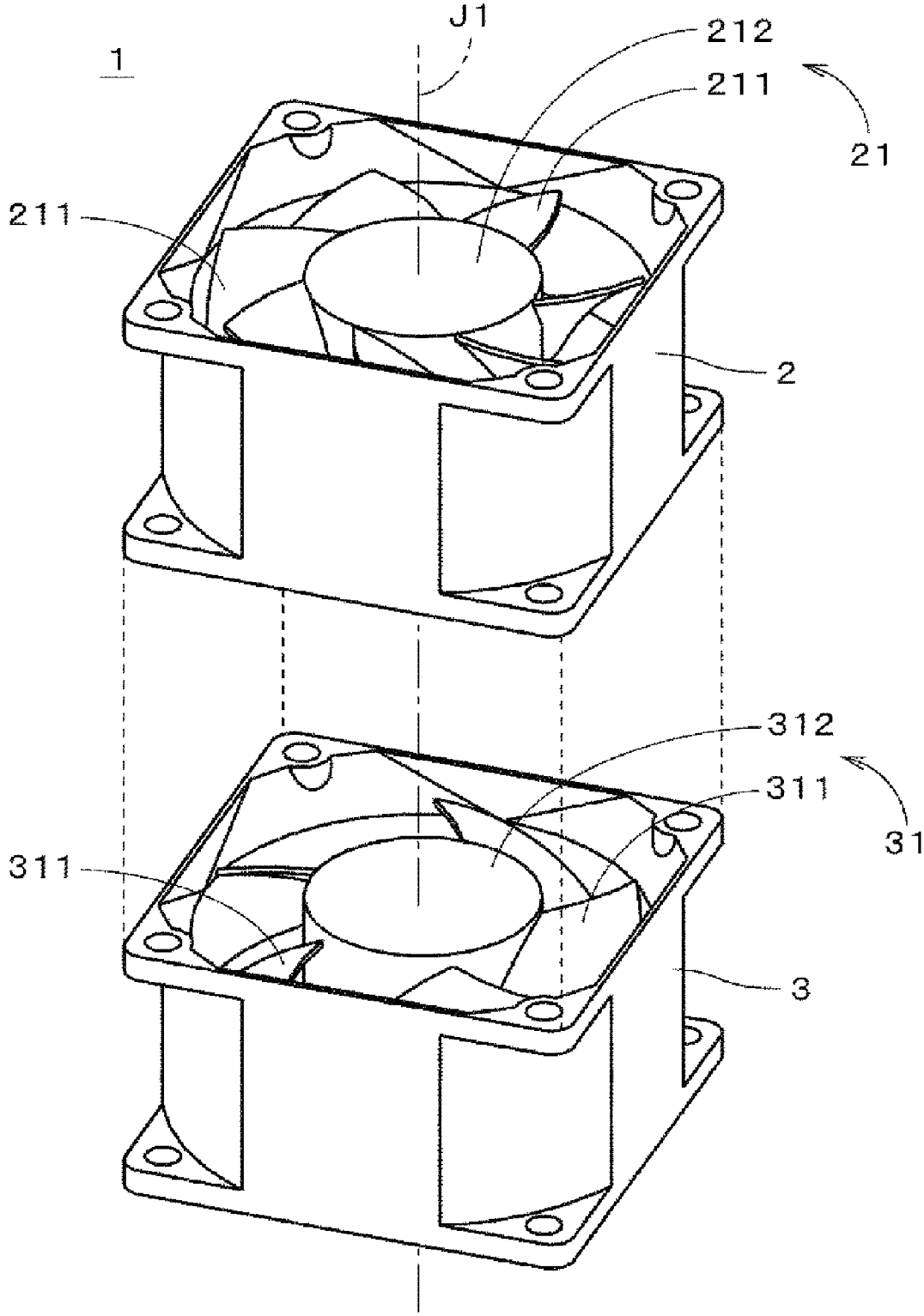
FIG. 2 shows two axial fans defining the axial fan unit of FIG. 1 which are separated from each other.

FIG. 1 is a perspective view of an axial fan unit 1 according to a first preferred embodiment of the present invention. The axial fan unit 1 includes a first axial fan 2 and a second axial fan 3 which are disposed coaxially with each other. FIG. 2 shows the first and second axial fans 2 and 3 which are separated from each other. The axial fan unit 1 is used for cooling the inside of an electronic device such as a server, for example. In the example of FIG. 1, the first axial fan 2 is disposed above the second axial fan 3 in an axial direction parallel to or substantially parallel to a center axis of the axial fan unit 1. The first and second axial fans 2 and 3 are connected to each other, for example, by screwing.

The axial fan unit 1 of this preferred embodiment serves as a so-called contra-rotating axial fan in which a first impeller 21 of the first axial fan 2 and a second impeller 31 of the second axial fan 3 rotate in opposite directions relative to each other. The rotation of the first and second impellers 21 and 31 allows air to be taken in from the upper side in FIG. 1 (i.e., from above the first axial fan 2 side) and be sent downward (i.e., toward the second axial fan 3), so that an air flowing generally in the axial direction is created. In the following description, the upper side in FIG. 1 from which air is taken in is referred to as an air-inlet side while the lower side in FIG. 1 from which air is discharged is referred to as an air-outlet side. Since rotating directions of the first and second impellers 21 and 31 are opposite to each other in the axial fan unit 1, a higher static pressure and a larger flow rate of air can be achieved as compared with an axial fan unit in which two impellers rotate in the same direction as each other.

Figure 3:
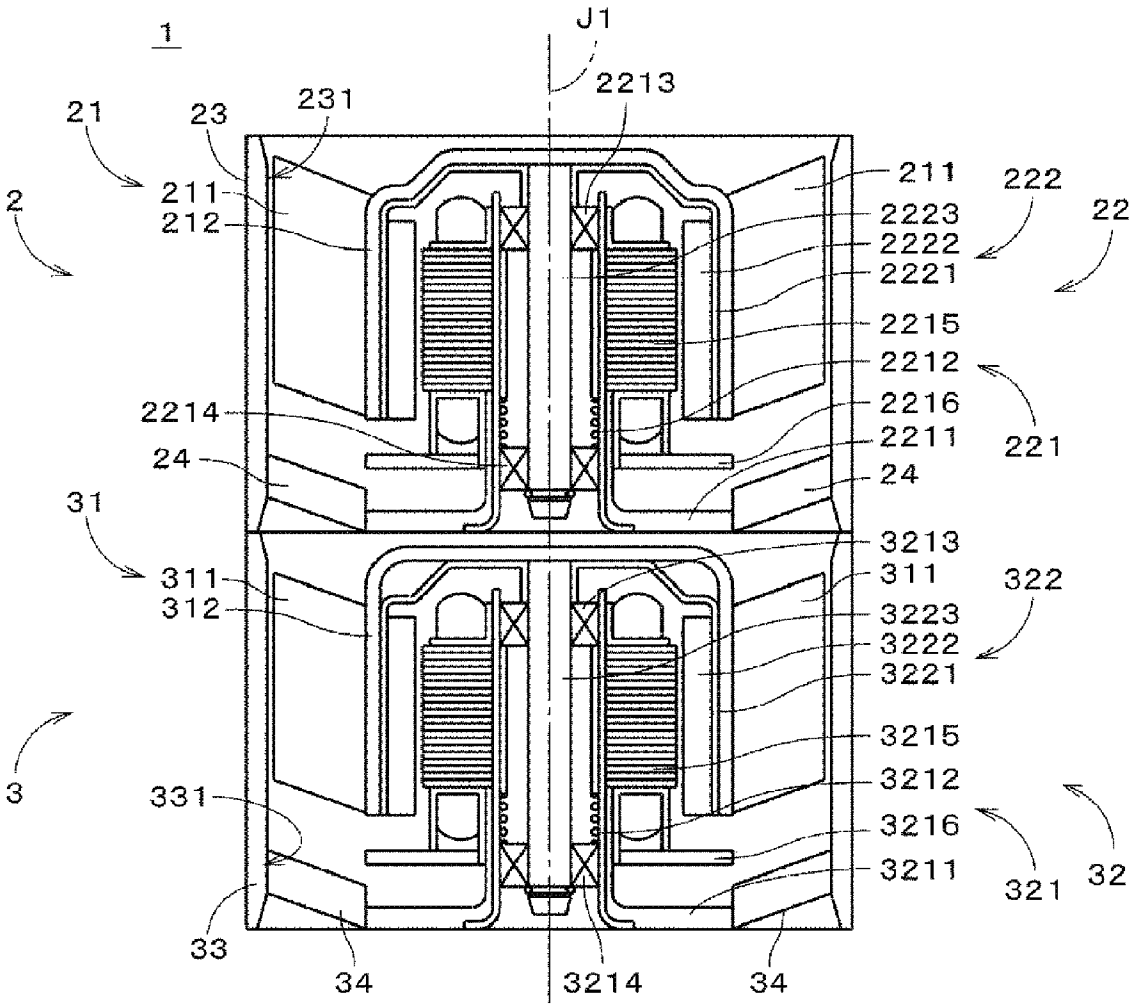
FIG. 3 is a cross-sectional view of the axial fan unit of FIG. 1.
Figure 4:
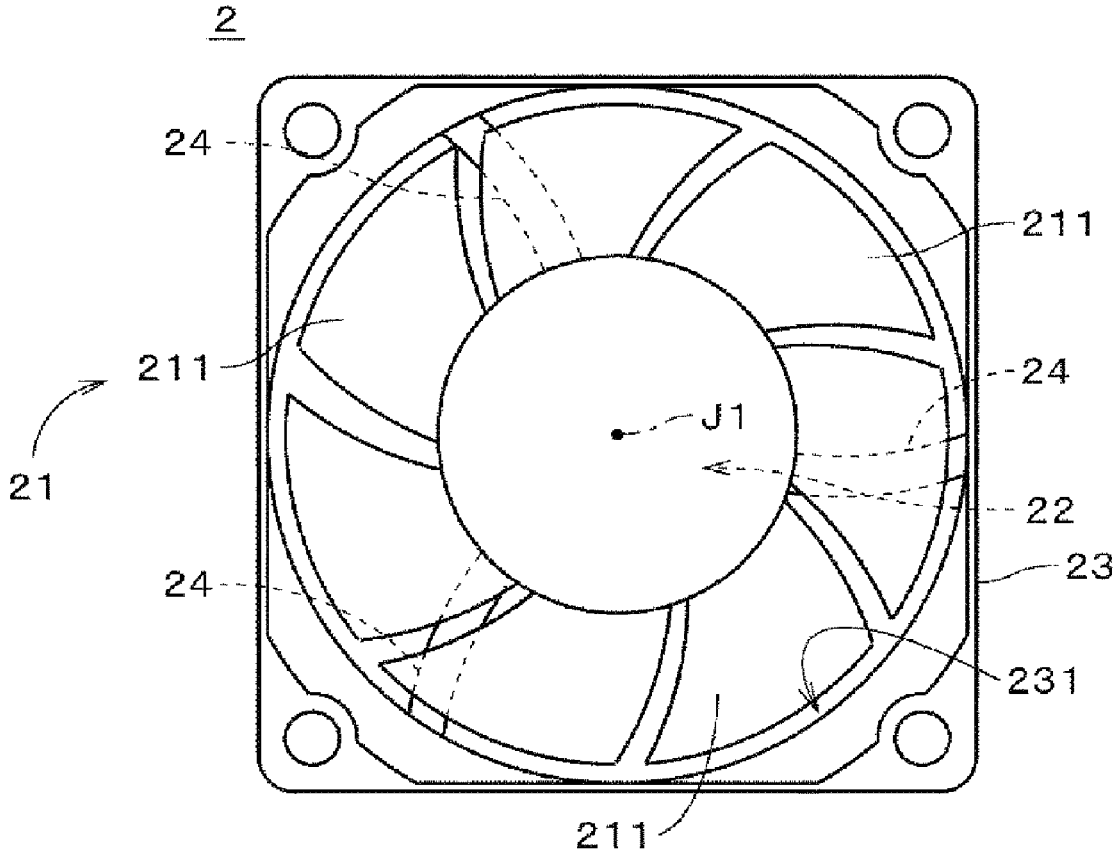
FIG. 4 is a plan view of a first axial fan of the axial fan unit of FIG. 1.

FIG. 3 is a cross-sectional view of the axial fan unit 1, taken along a plane including the center axis J1 thereof. FIG. 4 is a plan view of the first axial fan 2 as seen from the air-inlet side. Referring to FIGS. 3 and 4, the first axial fan 2 includes the first impeller 21 having a plurality of first blades 211 disposed about the center axis J1 at regular circumferential intervals. The first blades 211 extend outward in a radial direction that is perpendicular to or substantially perpendicular to the center axis J1. In this preferred embodiment, seven first blades 211 are provided, for example. The first axial fan 2 also includes a first motor 22 which rotates the first impeller 21 about the center axis J1 in a first rotating direction to create an airflow flowing generally in the axial direction. In this preferred embodiment, the first motor 22 rotates the first impeller 21 in a clockwise direction in FIGS. 2 and 4, thereby creating an airflow flowing downward in FIG. 3 generally in the axial direction. The first impeller 21 is radially surrounded by a first housing piece 23. A plurality of first ribs 24 are disposed below the first impeller 21 in the axial direction in FIG. 3, i.e., axially between the first and second impellers 21 and 31. The first ribs 24 are disposed about the center axis J1 so as to extend outward in the radial direction and are connected to the first motor 22 and the first housing piece 23. Thus, the first ribs 24 secure the first motor 22 to the first housing piece 23. In this preferred embodiment, three first ribs 24 are provided, for example. In the first axial fan 2, the first impeller 21, the first motor 22, and the first ribs 24 are accommodated inside the first housing piece 23.

FIG. 3 merely shows general shapes of each first blade 211 and each first rib 24 when seen in the radial direction, for the sake of convenience. Moreover, diagonal lines for representing a cross-section of a component are omitted for various components of the first motor 22. These are the same for the second axial fan 3 of this preferred embodiment, and are also the same for the second axial fans in other preferred embodiments of the present invention shown in FIGS. 6, 8 to 11, and 13 to 15.

Referring to FIG. 3, the first motor 22 includes a stationary portion 221 as a stationary assembly and a rotor portion 222 as a rotating assembly. The rotor portion 222 is supported by a bearing mechanism detailed later, in a rotatable manner about the center axis J1 relative to the stationary portion 221. In the following description, it is assumed that the center axis J1 is coincident with a direction of gravity. However, the center of axis J1 is not always coincident with the direction of gravity.

The stationary portion 221 includes a base portion 2211. In this preferred embodiment, the base portion 2211 preferably is in the form of a generally annular plate centered on the center axis J1 as seen in the axial direction. The base portion 2211 is secured to an inner surface 231 of the first housing piece 23 with the first ribs 24 to support various components of the stationary portion 221, as shown in FIGS. 3 and 4. In this preferred embodiment, the first housing piece 23 is hollow and generally cylindrical and is made of resin. The base portion 2211 and the first ribs 24 are also made of resin in this preferred embodiment. The first housing piece 23, the base portion 2211, and the first ribs 24 are formed by injection molding, for example.

Referring to FIG. 3, a hollow bearing holder 2212 is received in an opening at a center of the base portion 2211 and is secured to the base portion 2211. In this preferred embodiment, the bearing holder 2212 is generally cylindrical. The bearing holder 2212 extends upward from the base portion 2212, i.e., toward the rotor portion 222 in the axial direction. Inside the bearing holder 2212 are disposed ball bearings 2213 and 2214 which define a portion of the bearing mechanism. The ball bearings 2213 and 2214 are axially separated from each other.

The stationary portion 221 includes an armature 2215 attached outside the bearing holder 2212 in the radial direction. In this preferred embodiment, the armature 2215 is attached to the base portion 2211 around the bearing holder 2212. A circuit board 2216 is attached below the armature 2215 and is electrically connected to the armature 2215. The circuit board 2216 includes a circuit (not shown) which controls a driving current supplied to the armature 2215. In this preferred embodiment, the circuit board 2216 is in the form of a generally ring-shaped plate. The circuit board 2216 is electrically connected to an external power supply (not shown) provided outside the axial fan unit 1 via a bundle of lead wires.

The rotor portion 222 includes a hollow yoke 2221 centered on the center axis J1, a magnet 2222 provided in the yoke 2221, and a shaft 2223 extending from the yoke 2221 axially downward. The yoke 2221 is made of magnetic metal and has a lid. In this preferred embodiment, the yoke 2221 is a hollow cylinder which is substantially closed at one axial end and is opened at the other axial end. The magnet 2222 in the yoke 2221 is disposed on an inner side surface of the yoke 2221 to radially face the armature 2215. In this preferred embodiment, the magnet 2222 is also hollow and generally cylindrical.

The shaft 2223 is inserted into the bearing holder 2212 and is supported by the ball bearings 2213 and 2214 in a rotatable manner. In the axial fan 2, the shaft 22 and the ball bearings 2213 and 2214 define a bearing mechanism which supports the yoke 2221 in a rotatable manner about the center axis J1 relative to the base portion 2211.

The first impeller 21 includes a hub 212 covering an outer surface of the yoke 2221 of the first motor 22, and a plurality of first blades 211 extending from an outer side surface of the hub 212 radially outward. The hub 212 is hollow and generally cylindrical in this preferred embodiment. The hub 212 and the first blades 211 are made of resin and are formed by injection molding, for example.

In the first axial fan 2, a driving current supplied to the armature 2215 is controlled by the circuit (not shown) of the circuit board 2216 of the first motor 22, so that a torque is generated about the center axis J1 between the armature 2215 and the magnet 22. Thus, the first blades 211 of the first impeller 21 are turned about the center axis J1 in a clockwise direction in FIG. 4, for example. In this preferred embodiment, the first impeller 21 is rotated at, for example, about 1000 $min^{-1}$. As a result, air is taken in from the upper side in FIG. 3 (from the rotor portion 222 side) and is sent downward (i.e., toward the second axial fan 3).

Figure 5:
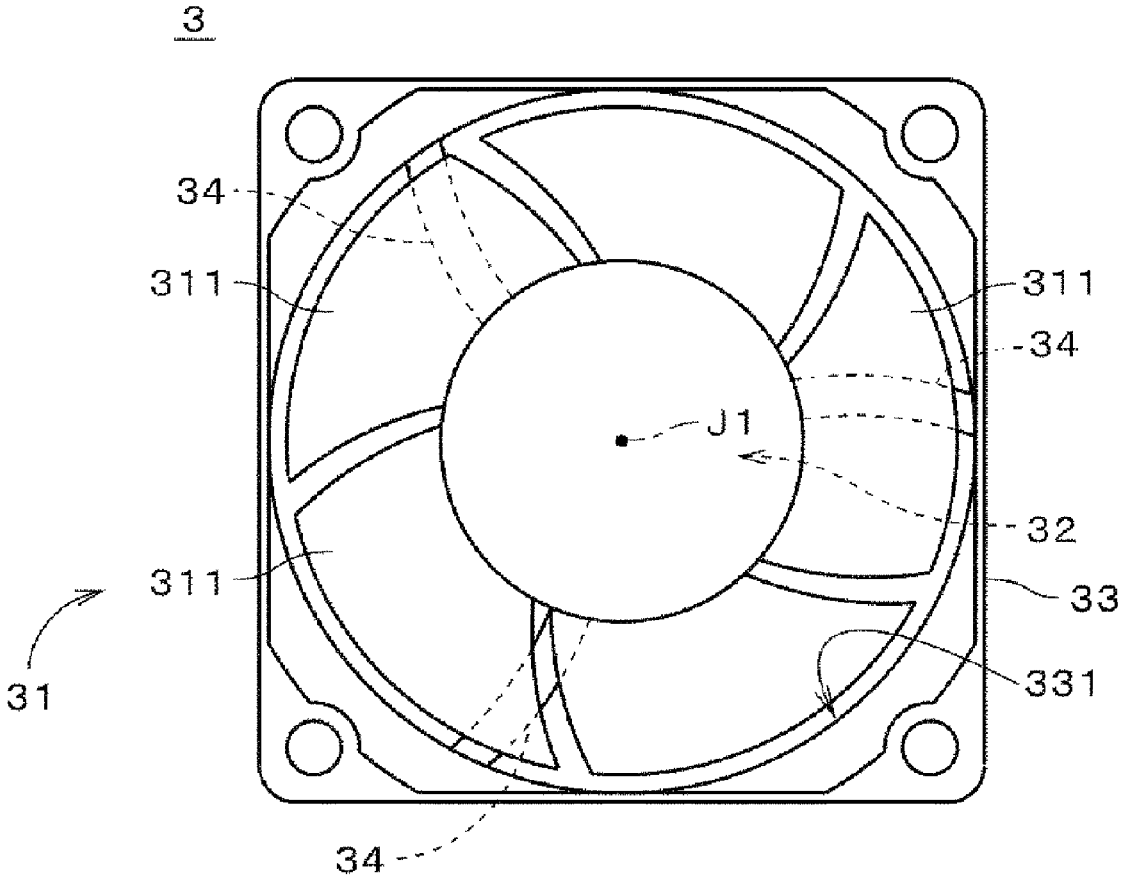
FIG. 5 is a plan view of a second axial fan of the axial fan unit of FIG. 1.

FIG. 5 is a plan view of the second axial fan 3 as seen in the axial direction. Referring to FIGS. 3 and 5, the second axial fan 3 includes a second impeller 31 disposed adjacent to the first impeller 21 in the axial direction. The second impeller 31 is coaxial with the first impeller 21. The second impeller 31 has a plurality of second blades 311 which are disposed about the center axis J1 at regular circumferential intervals and extend radially outward. In this preferred embodiment, five second blades 311 are provided.

The second axial fan 3 also includes a second motor 32 for rotating the second impeller 31 about the center axis J1. In this preferred embodiment, the second motor 32 rotates the second impeller 31 in a second rotating direction opposite to the first rotating direction, i.e., a counterclockwise direction in FIG. 5. The rotation of the second impeller 31 creates an airflow flowing generally in the same direction as the airflow created by the rotation of the first impeller 21. In this preferred embodiment, the airflows flow downward generally in the axial direction.

The second impeller 31 is radially surrounded by a second housing piece 33. A plurality of second ribs 34 are disposed below the second impeller 31, i.e., on the opposite side of the second impeller 31 to the first impeller 21. The second ribs 34 are disposed about the center axis J1 and extend radially outward to be connected to the second motor 32 and the second housing piece 33. That is, the second ribs 34 secure the second motor 32 to the second hosing piece 33. In this preferred embodiment, three second ribs 34 are provided.

In the second axial fan 3, the second impeller 31, the second motor 32, and the second ribs 34 are accommodated inside the second housing piece 33. Moreover, in the entire axial fan unit, the first impeller 21, the first ribs 24, the second impeller 31, and the second ribs 34 are disposed in that order from the upper side in FIG. 3 (i.e., from the air-inlet side) in an air passage defined in the first housing piece 23 and the second housing piece 33 which are joined to each other. In the axial fan unit 1 of this preferred embodiment, the number of the first ribs 24 is preferably the same as that of the second ribs 34.

The structure of the second motor 32 is preferably the same as that of the first motor 22, as shown in FIG. 3, and includes a stationary portion 321 and a rotor portion 322 disposed above the stationary portion 321 (i.e., on the air-inlet side of the stationary portion 321). The rotor portion 322 is supported in a rotatable manner relative to the stationary portion 321.

The stationary portion 321 is secured to an inner surface 331 of the second housing piece 33 with the second ribs 34. In this preferred embodiment, the second housing piece 33 is hollow and generally cylindrical. The stationary portion 321 includes a base portion 3211 which supports other components of the stationary portion 321, a hollow bearing holder 3212 in which ball bearings 3213 and 3214 are disposed, and an armature 3215 attached radially outside the bearing holder 3212. The bearing holder 3212 is hollow and generally cylindrical in this preferred embodiment. Below the armature 3215 of the stationary portion 321 is provided a circuit board 3216 which is electrically connected to the armature 3215. In this preferred embodiment, the circuit board 3216 is generally ring-shaped. The circuit board 3216 includes a circuit (not shown) which controls a driving current supplied to the armature 3215.

In this preferred embodiment, the base portion 3211, the second ribs 34, and the second housing piece 33 are made of resin, and are formed by injection molding, for example. The circuit board 3216 is electrically connected to an external power supply (not shown) provided outside the axial fan unit 1 via a bundle of lead wires.

The rotor portion 322 includes a metal yoke 3221, a magnet 3222 secured to an inner side surface of the yoke 3221, and a shaft 3223 extending downward from the yoke 3221. The shaft 3223 is supported by the ball bearings 3213 and 3214 in the bearing holder 3212 in a rotatable manner about the center axis J1. In the second axial fan 3, the shaft 3223 and the ball bearings 3213 and 3214 serve as a bearing mechanism which supports the yoke 3221 in a rotatable manner about the center axis J1 relative to the base portion 3211.

The second impeller 31 includes a hub 312 covering an outer surface of the yoke 3221 of the second motor 32 and a plurality of second blades 311 extending from an outer side surface of the hub 312 radially outward. In this preferred embodiment, the hub 312 and the second blades 311 are made of resin and are formed by injection molding, for example.

In the second axial fan 3, when the second motor 32 is driven, the second blades 311 of the second impeller 31 are turned about the center axis J1 in a counterclockwise direction in FIG. 5, for example. In this preferred embodiment, the second blades 311 are turned about at, for example, about 8000 $min^{-1}$. Due to this rotation, air is taken in from the upper side in FIG. 3 (i.e., from the first axial fan 2 side) and is sent downward (i.e., toward the second ribs 34).

Figure 6:
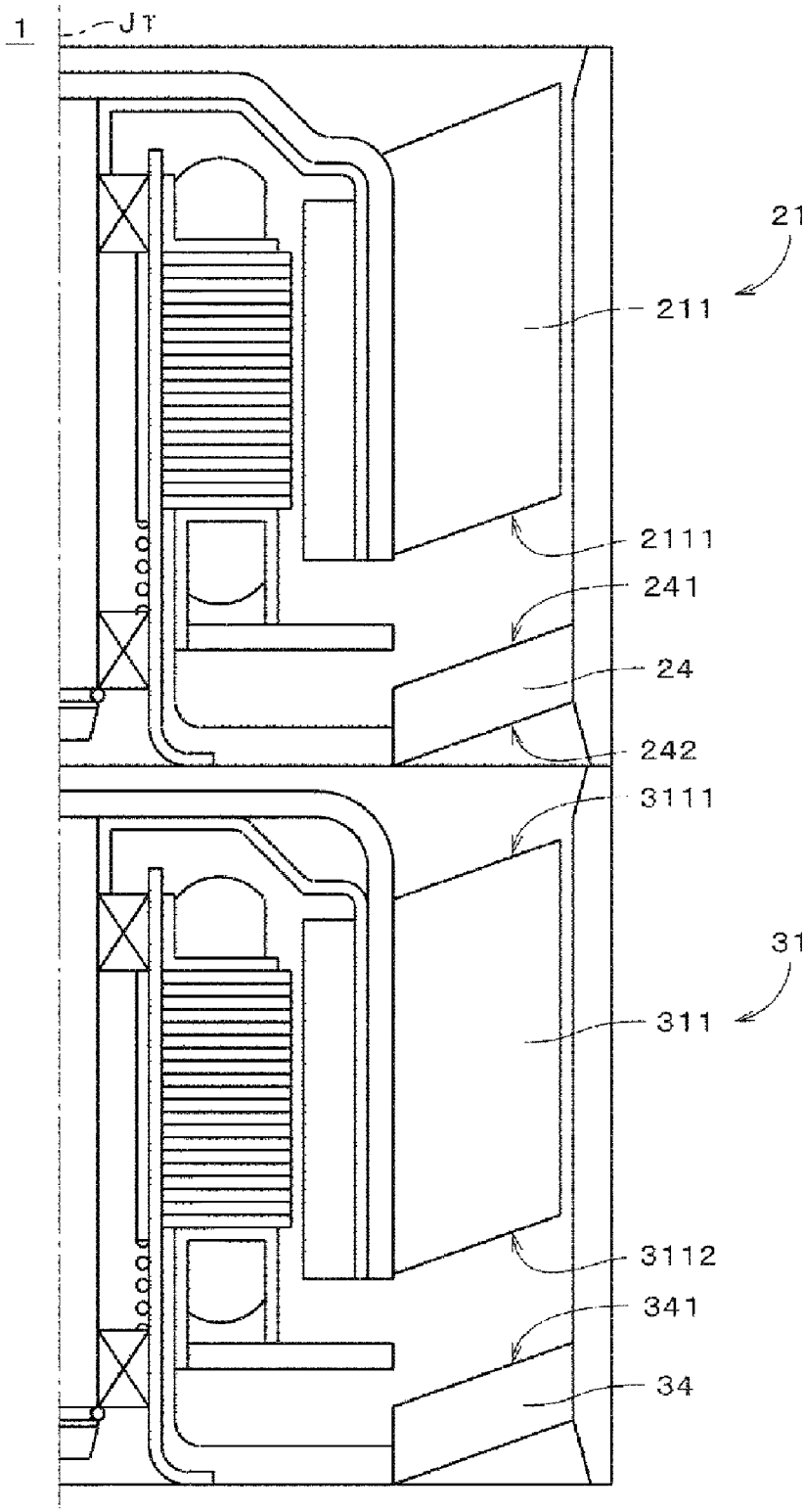
FIG. 6 is a cross-sectional view of a portion of the axial fan unit of FIG. 1.

FIG. 6 is an enlarged cross-sectional view of a portion (a right half) of the axial fan unit 1 with respect to the center axis J1. Referring to FIG. 6, in the axial fan unit 1, a second-impeller side edge 2111 of the first blade 211, which is a trailing edge (air-outlet side edge) of the first blade 211 from which air is separated from the first blade 211, is inclined with respect to the radial direction that is perpendicular to or substantially perpendicular to the center axis J1 such that the edge 2111 (hereinafter, referred to as the first blade edge 2111) gets closer to the air-inlet side end of the axial fan unit 1 as it moves away from the center axis J1. Similarly, a first-impeller side edge 241 (hereinafter, referred to a first rib edge) of the first rib 24 is also inclined with to the radial direction such that it gets closer to the air-inlet side end of the axial fan unit 1 as it moves away from the center axis J1. That is, not only the first blade edge 2111 but also the first rib edge 241 get closer to the air-inlet side end of the axial fan unit 1 as they move away from the center axis J1. Furthermore, a first-impeller side edge 3111 of the second blade 311, which also serves as an air-inlet side edge or a leading edge of the second blade 311, and a second-impeller side edge (hereinafter, referred to as a second rib edge) 242 of the first rib 24 are also inclined with respect to the radial direction such that they get closer to the air-inlet side end of the axial fan unit 1 as they move away from the center axis J1.

Please note that, in the axial fan unit 1, the first blades 211, the first supporting ribs 24 and the second blades 311 other than those shown in FIG. 6 are also inclined in a similar manner to those shown in FIG. 6, such that they get closer to the air-inlet side end of the axial fan unit 1 as they move away from the center axis J1.

It is assumed that an envelope formed by turning the first blade edges 2111 of the first blades 211 about the center axis J1 is a first envelope and an envelope formed by turning the second blade edges 3111 of the second blades 311 about the center axis J1 is a second envelope. The first rib edges 241 of the first ribs 24 extend along the first envelope such that a distance between the first rib edges 241 and the first envelope is approximately constant. The second rib edges 242 of the first ribs 24 extend along the second envelope such that a distance between the second rib edges 242 and the second envelope is approximately constant.

The distance between the first rib edges 241 and the first envelope may be appropriately determined so as to substantially separate the first rib edges 241 and the first envelope from each other. For example, the aforementioned distance between the first rib edges 241 and the first envelope may be an axial distance therebetween or may be a shortest distance therebetween. This is the same for the distance between the second rib edges 242 and the second envelope. In the following description, the distance between the rib edges and the corresponding envelope is defined as an axial distance therebetweeen.

In the axial fan unit 1, at any position on each first rib 24 in the radial direction, the axial distance between the first rib edge 241 and the first envelope is equal to or substantially equal to the axial distance between the second rib edge 242 and the second envelope.

In addition, an edge 3112 of each second blade 311 of the second impeller 31, which is opposite to the first impeller 21 and serves as an air-outlet side edge of the second blade 311, is inclined with respect to the radial direction such that it gets closer to the air-inlet side end of the axial fan unit 1 as it moves away from the center axis J1. The edge 3112 of the second blade 311 is hereinafter referred to as a third blade edge 3112. Moreover, a second impeller side edge of each second rib 34, i.e., an air-inlet side edge 341 is also inclined to the radial direction such that it gets closer to the air-inlet side end of the axial fan unit 1 as it moves away from the center axis J1. The third rib edges 341 extend along a third envelope formed by turning the third blade edges 3112 about the center axis J1 with an axial distance therebetween kept approximately constant.

Figure 7:
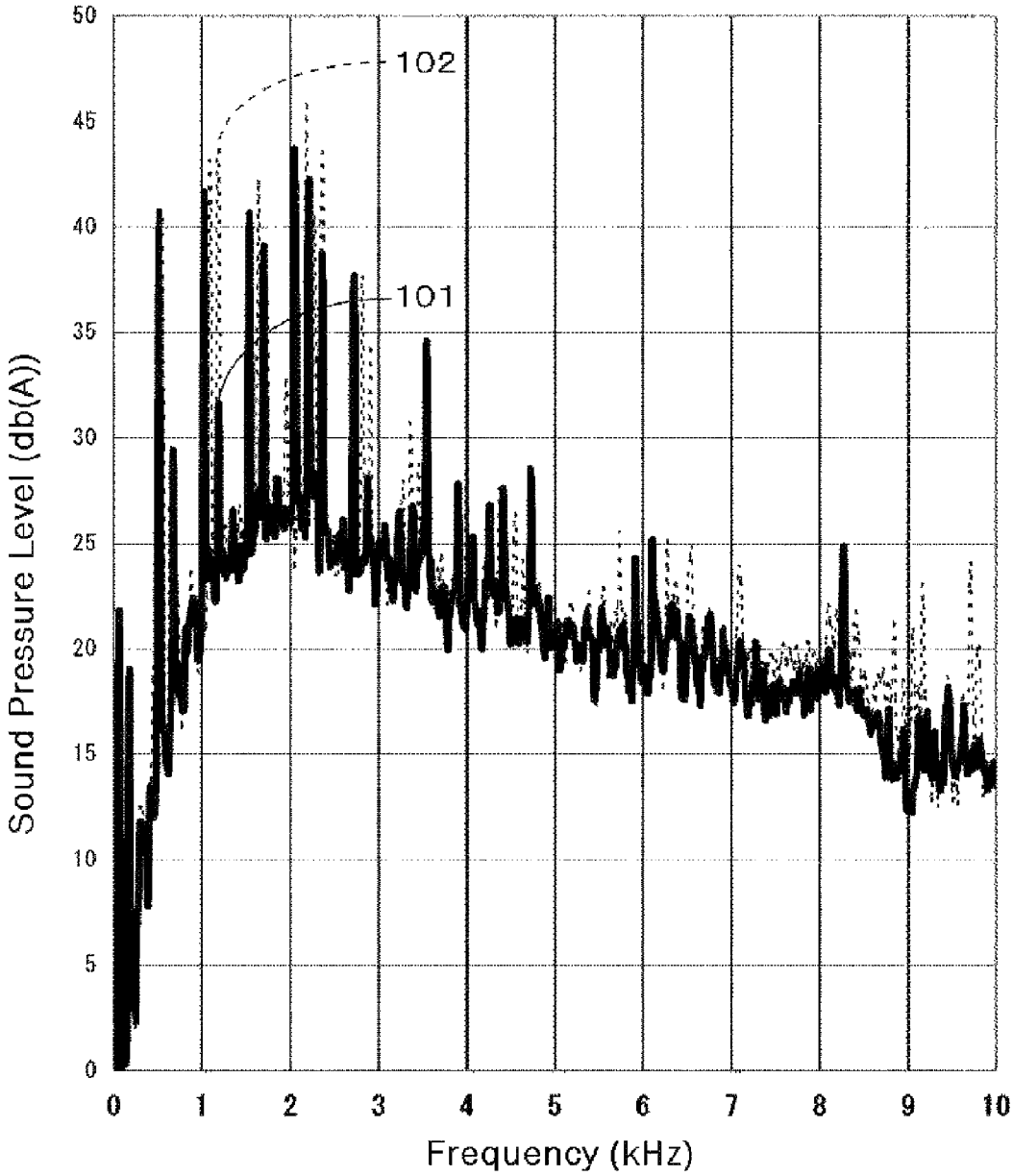
FIG. 7 shows a relationship between frequencies of noises of the axial fan unit of FIG. 1 and a sound pressure level thereof.

FIG. 7 shows a relationship between the frequencies and the sound pressure level of noises of the axial fan unit 1. Curve 101 represents the noises of the axial fan unit 1 of this preferred embodiment, while curve 102 represents noises of an axial fan unit of Comparative Example in which the first and second blades have the same shapes as those of the axial fan unit 1 but the first and second rib edges of the first ribs extend perpendicular to the center axis of the axial fan unit. As shown in FIG. 7, the noise is reduced in the axial fan unit 1 by about 10 dB around a frequency of 1.167 kHz (this frequency corresponds to a first-order rotation frequency component of the first impeller 21), as compared with the axial fan unit of Comparative Example.

As described above, the first rib edges 231 of the first ribs 24 and the first blade edges 2111 as the air-outlet side edges of the first blades 211 are inclined with respect to the radial direction toward the same direction, i.e., toward the air-inlet side end of the axial fan unit 1. Thus, interference of air sent from the first blades 211 with the first ribs 24 can be suppressed and therefore the noises of the axial fan unit 1 can be reduced. Moreover, the axial distance between the first envelope obtained by turning the first blade edges 2111 about the center axis J1 and the first rib edges 241 is kept approximately constant. Thus, the interference of the air from the first blades 211 with the first ribs 24 can be further suppressed, resulting in further reduction in the noises of the axial fan unit 1.

Also, the second rib edges 242 of the first ribs 24 and the second blade edges 3111 as the air-inlet side edges of the second blades 311 are inclined with respect to the radial direction toward the same direction, i.e., toward the air-inlet side end of the axial fan unit 1. Thus, interference of air flowing into the second blades 311 and the first ribs 24 can be suppressed and therefore the noises of the axial fan unit 1 can be further reduced. Since the axial distance between the second envelope obtained by turning the second blade edges 3111 about the center axis J1 and the second rib edges 242 are kept approximately constant, the interference of the air flowing into the second blades 311 with the first ribs 24 can be further effectively suppressed, resulting in further reduction in the noises of the axial fan unit 1.

In addition, the axial distance between the first rib edges 241 of the first ribs 24 and the first envelope and the axial distance of the second rib edges 242 and the second envelope are equal to or substantially equal to each other. Therefore, interference of air flowing around the first ribs 24 with the first ribs 24 can be suppressed, resulting in further reduction in the noises of the axial fan unit 1.

In the axial fan unit 1, the second ribs 34 are disposed on the air-outlet side of the second impeller 31, i.e., on the opposite side of the second impeller 31 to the first impeller 21, and what interferes with air sent from the first blades 211 between the first and second impellers 21 and 31 is the first ribs 24 only. Thus, the noises of the axial fan unit 1 can be further reduced.

In a region adjacent to the air-outlet side end of the axial fan unit 1, the third rib edges 231 of the second ribs 34 and the third blade edges 3112 as the air-outlet side edges of the second blades 3111 are inclined with respect to the radial direction toward the same direction, i.e., toward the air-inlet side end of the axial fan unit 1. Thus, interference of air sent out from the second blades 311 with the second ribs 34 can be suppressed. This contributes to further reduction in the noises of the axial fan unit 1. Moreover, the axial distance between the third envelope obtained by turning the third blade edges 3112 about the center axis J1 and the third rib edges 231 are kept approximately constant. Thus, the interference of the air from the second blades 311 with the second ribs 34 can be further suppressed, resulting in further reduction in the noises of the axial fan unit 1.

In the axial fan unit 1, two housing pieces which are formed separately from each other, i.e., the first and second housing pieces 23 and 33 are joined to each other to form a hollow housing which radially surrounds the first and second impellers 21 and 31. With this configuration, the housing of the axial fan unit 1 can be easily formed. It is also possible to easily attach the first and second impellers 21 and 31 and the first and second motors 22 and 32 to the housing. Consequently, the axial fan unit 1 can be easily manufactured.

Second Preferred Embodiment

Figure 8:
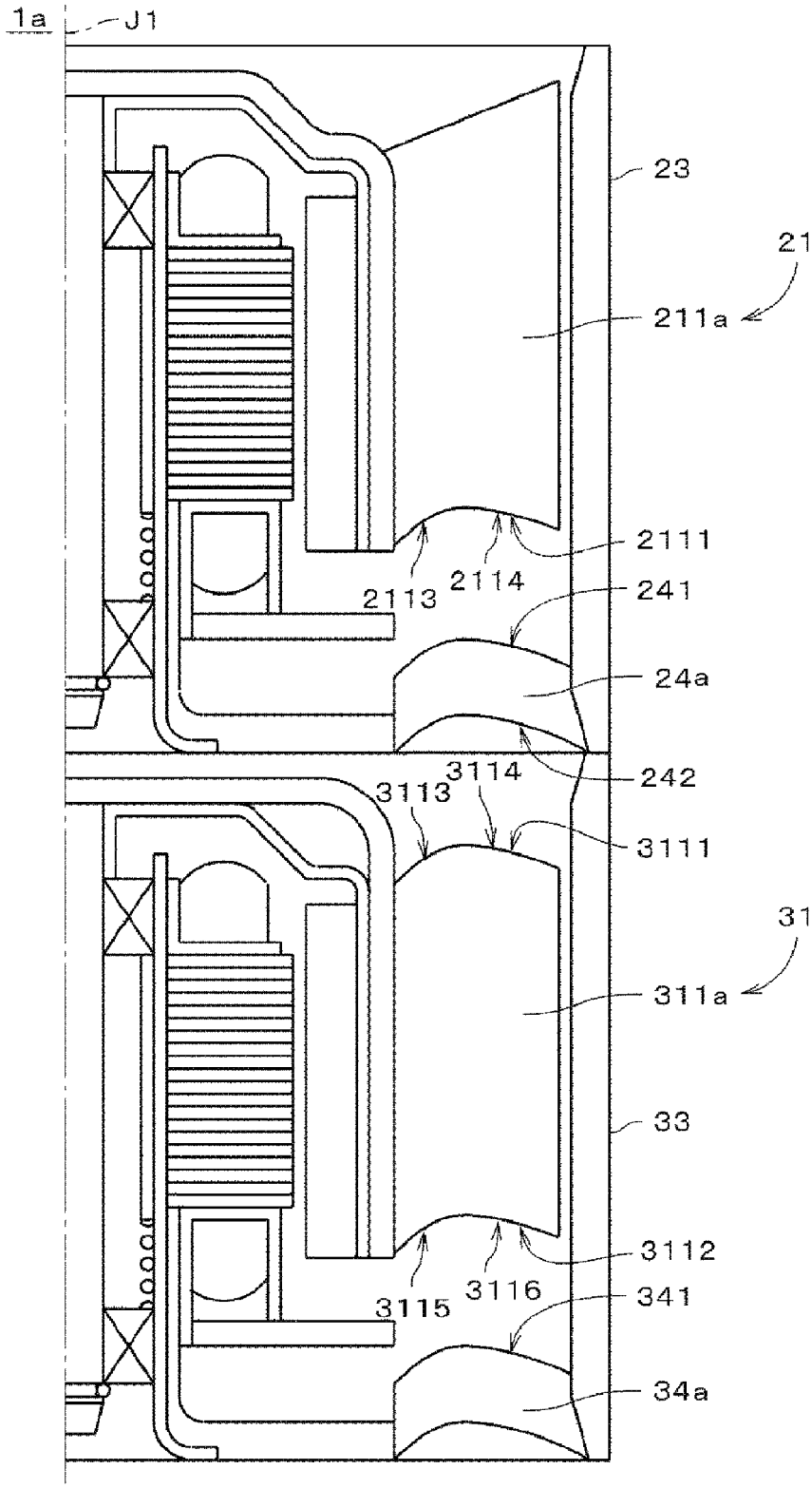
FIG. 8 is a cross-sectional view of a portion of an axial fan unit according to a second preferred embodiment of the present invention.

An axial fan unit according to a second preferred embodiment of the present invention is now described. FIG. 8 is a cross-sectional view of a portion of the axial fan unit 1*a* of the second preferred embodiment. As shown in FIG. 8, first blades 211*a* and second blades 311*a* are provided in the axial fan unit 1*a*, in place of the first and second blades 211 and 3111 of the axial fan unit 1 shown in FIG. 3. Moreover, the first and second ribs 24 and 34 of the axial fan unit 1 of the first preferred embodiment are replaced with first and second ribs 24*a* and 34*a* which are different from the first and second ribs 24 and 34 in shapes of rib edges. Except for the above, the axial fan unit 1*a* of this preferred embodiment is preferably substantially the same as the axial fan unit 1 of the first preferred embodiment. Therefore, like parts are given like reference numerals in the following description.

Referring to FIG. 8, the first blade edge 2111 which is a second impeller side or an air-outlet side edge of each first blade 211*a* of the first impeller 21 includes an inclined portion 2113 and another inclined portion 2114 both of which are inclined with respect to the radial direction. The inclined portion 2113 is disposed radially inside the inclined portion 2114, i.e., on the center axis side of the inclined portion 214, and is inclined such that it gets closer to the air-inlet side end of the axial fan unit 1*a* (the upper side in FIG. 8) as it moves away from the center axis J1. The inclined portion 2114 is disposed radially outside the inclined portion 2113 and is inclined such that it gets closer to the air-outlet side end of the axial fan unit 1*a* as it moves away from the center axis J1.

Similarly, the second blade edge 3111 which is the first impeller side edge or the air-inlet side edge of each second blade 311*a* of the second impeller 31 includes an inclined portion 3113 and another inclined portion 3114, both of which are inclined with respect to the radial direction. The inclined portion 3113 is disposed radially inside the inclined portion 3114 and is inclined such that as it gets closer to the air-inlet side end of the axial fan unit 1*a* as it moves away from the center axis J1. The inclined portion 3114 is disposed radially outside the inclined portion 3114 and is inclined such that it gets closer to the air-outlet side end of the axial fan unit 1*a* as it moves away from the center axis J1.

Between the first and second impellers 21 and 31, the first rib edges 241 of the first ribs 24*a*, which are the first impeller side edges or the air-inlet side edges, extend along the first envelope obtained by turning the first blade edges 2111 of the first blades 211*a* about the center axis J1 with a gap kept between the first envelope and the first rib edges 241. Similarly, the second rib edges 242 of the first ribs 24, which are the second impeller side edges or the air-outlet side edges, extend along the second envelope obtained by turning the second blade edges 3111 of the second blades 311*a* about the center axis J1 with a gap kept between the second envelope and the second rib edges 242.

In the axial fan unit 1*a*, at any position on each first rib 24*a* in the radial direction, the axial distance between the first rib edges 241 and the first envelope and the axial distance between the second rib edges 242 and the second envelope are approximately constant and approximately equal to each other.

Each of the third blade edges 3112 of the second blades 311*a* of the second impeller 31, which are the edges on the air-outlet side or the opposite side of the second blades 311*a* to the first impeller 21, includes an inclined portion 3115 and another inclined portion 3116. The inclined portion 3115 gets closer to the air-inlet side end of the axial fan unit 1*a* as it moves away from the center axis J1, while the other inclined portion 3116 gets closer to the air-outlet side end of the axial fan unit 1*a* as it moves away from the center axis J1. The third rib edges 341 of the second ribs 34*a*, which are the second impeller side or the air-inlet side edges, extend along the third envelope obtained by turning the third blade edges 3112 of the second blades 311*a* about the center axis J1 with a gap kept between the third envelope and the third rib edges 341. At any position on each second rib 34*a* in the radial direction, the axial distance between the third rib edge 341 and the third envelope is approximately the same.

Since the first rib edges 241 of the first ribs 24*a* extend along the first blade edges 2111 of the first blades 211*a*, interference of air sent from the first blades 211*a* with the first ribs 24*a* can be suppressed, thus reducing noises of the axial fan unit 1*a*. Moreover, the axial distance between the first rib edges 241 and the first envelope is approximately constant. Thus, the interference of the air from the first blades 211*a* with the first ribs 24*a* can be further suppressed, resulting in further reduction in the noises of the axial fan unit 1*a*.

In the axial fan unit 1*a* of FIG. 8, the second rib edges 242 of the first ribs 24*a* extend along the second blade edges 3111 of the second blades 311*a*. Thus, interference of air flowing into the second blades 311*a* with the first ribs 24*a* can be suppressed. This results in further reduction in the noise of the axial fan unit 1*a*. Moreover, since the axial distance between the second rib edges 242 and the second envelope is approximately constant, the interference of the air flowing into the second blades 311*a* with the first ribs 24*a* can be further suppressed. This contributes to further reduction in the noises of the axial fan unit 1*a*.

In addition, the axial distance between the first rib edges 241 of the first ribs 24*a* and the first envelope is approximately equal to the axial distance between the second rib edges 242 and the second envelope. Thus, interference of air flowing around the first ribs 24*a* with the first ribs 24*a* can be further suppressed, resulting in further reduction of the noises of the axial fan unit 1*a*.

In an air-outlet side region of the axial fan unit 1*a*, the third rib edges 341 of the second ribs 34*a* extend along the third blade edges 3112 of the second blades 311*a*. Thus, interference of air sent out by the second blades 311*a* with the second ribs 34*a* can be suppressed, resulting in further reduction in the noises of the axial fan unit 1*a*. Moreover, since the axial distance between the third rib edges 341 and the third envelope is approximately constant, the interference of the air from the second blades 311*a* with the second ribs 34*a* can be further suppressed. Therefore, the noises of the axial fan unit 1*a* can be further reduced.

In the axial fan unit 1*a* of this preferred embodiment, the second ribs 34*a* are disposed on the air-outlet side of the second impeller 31, as in the first preferred embodiment. Therefore, the noises of the axial fan unit 1*a* can be further reduced. In addition, a hollow housing radially surrounding the first and second impellers 21 and 31 are formed by two separately formed housing pieces, i.e., the first and second housing pieces 23 and 33. Therefore, it is possible to easily manufacture the axial fan unit 1*a*. Furthermore, since the rotating directions of the first and second impellers 21 and 31 are opposite to each other, the static pressure and the flow rate of air of the axial fan unit 1*a* can be made larger.

Third Preferred Embodiment

Figure 9:
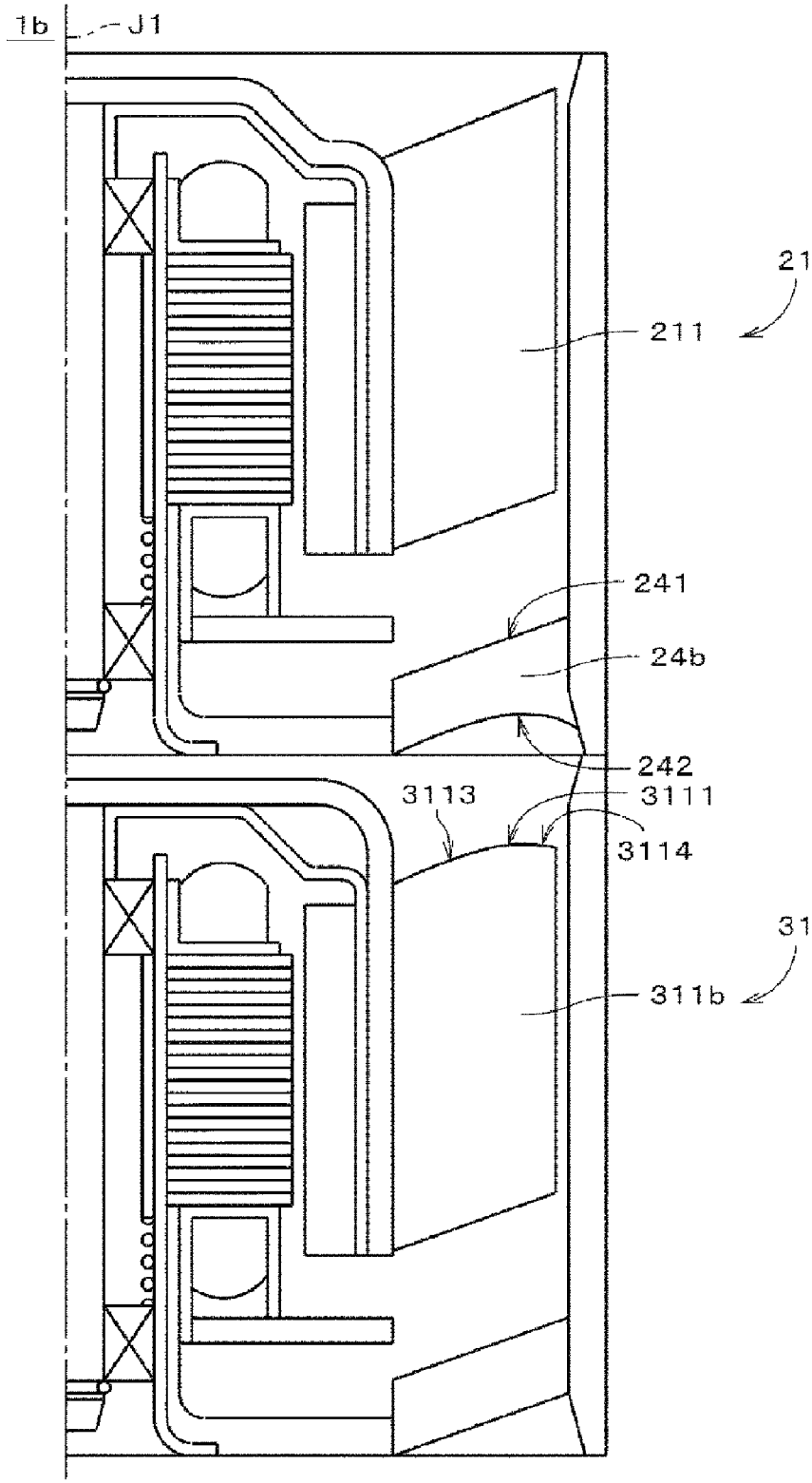
FIG. 9 is a cross-sectional view of a portion of an axial fan unit according to a third preferred embodiment of the present invention.

An axial fan unit according to a third preferred embodiment of the present invention is now described. FIG. 9 is a cross-sectional view of a portion of the axial fan unit 1*b* of the third preferred embodiment. As shown in FIG. 9, the axial fan unit 1*c* includes second blades 311*b* which are different in shape from the second blades 311 of the axial fan unit 1 of the first preferred embodiment shown in FIG. 1. Also, first ribs 24*b* provided in the axial fan unit 1*b* are different in rib edge shape from the first ribs 24 in the first preferred embodiment shown in FIG. 1. Except for the above, the axial fan unit 1*b* preferably is substantially the same as the axial fan unit 1 of the first preferred embodiment shown in FIG. 3. Therefore, like parts are given like reference numerals in the following description and FIG. 9.

Referring to FIG. 9, the second blade edge 3111 of each second blade 311*b* of the second impeller 31, which is the edge on the first impeller side or the air-inlet side of the second blade 311*b*, includes inclined portions 3113 and 3114 which are inclined with respect to the radial direction. The inclined portion 3113 which is disposed radially inside the inclined portion 3114 is inclined such that it gets closer to the air-inlet side end of the axial fan unit 1*b* as it moves away from the center axis J1. The inclined portion 3114 disposed radially outside the inclined portion 3113 is inclined such that it gets closer to the air-outlet side end of the axial fan unit 1*b* as it moves away from the center axis J1. Between the first and second impellers 21 and 31, the second rib edges 242 of the first ribs 24*b*, which are the second impeller side edges or the air-outlet side edges, extend along the second envelope obtained by turning the second blade edges 3111 of the second blades 311*b* about the center axis J1 with a gap kept between the second envelope and the second rib edges 242.

At any position on each first rib 24*b* in the radial direction, the axial distance between the second rib edges 242 and the second envelope is approximately constant and is approximately equal to the axial distance between the first rib edges 241 and the first envelope.

In the axial fan unit 1*b* of this preferred embodiment, interference of air sent by the first blades 211 with the first ribs 24*b* is suppressed as in the first and second preferred embodiments. Thus, noises of the axial fan unit 1*b* can be reduced. Moreover, interference of air flowing into the second blades 311*b* with the first ribs 24*b* can be suppressed. Thus, the noises of the axial fan unit 1*b* can be further reduced.

Fourth Preferred Embodiment

Figure 10:
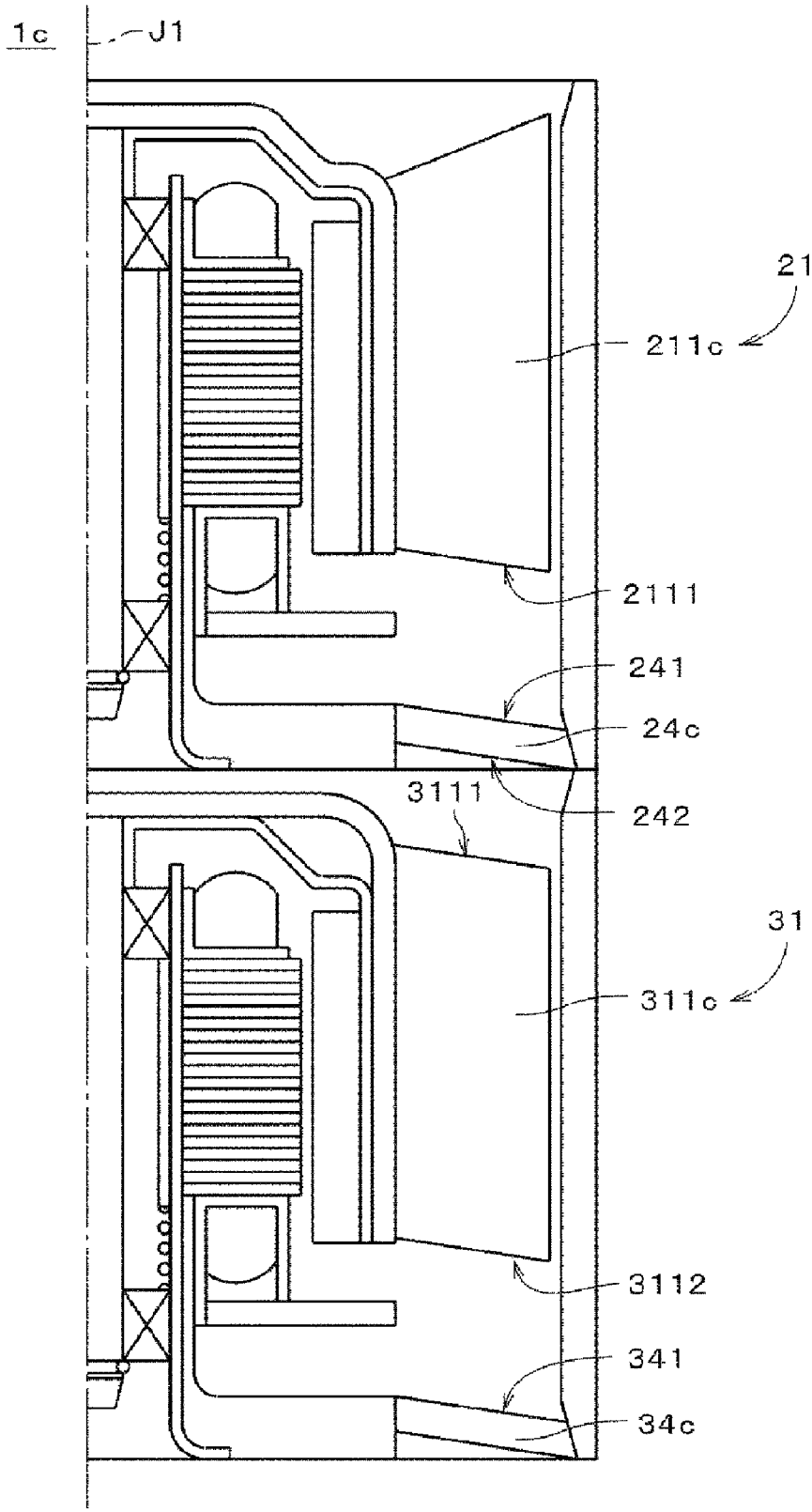
FIG. 10 is a cross-sectional view of a portion of an axial fan unit according to a fourth preferred embodiment of the present invention.

An axial fan unit according to a fourth preferred embodiment of the present invention is now described. FIG. 10 is a cross-sectional view of a portion of the axial fan unit 1*c* of the fourth preferred embodiment. As shown in FIG. 10, the axial fan unit 1*c* includes first blades 211*c* and second blades 311*c* which are different in the shape of blade edges from the first blades 211 and the second blades 311 of the axial fan unit 1 of the first preferred embodiment shown in FIG. 3. Also, first and second ribs 24*c* and 34*c* which are different in the shape of rib edges from the first and second ribs 24 and 34 in the first preferred embodiment are provided in the axial fan unit 1*c*. Except for the above, the axial fan unit 1*c* preferably is substantially the same as the axial fan unit 1 of the first preferred embodiment shown in FIG. 1. Therefore, like parts are given like reference numerals.

Referring to FIG. 10, in the axial fan unit 1*c*, the first blade edge 2111 of each first blade 211*c*, i.e., the second impeller side or the air-outlet side edge of each first blade 211*c* and the second blade edge 3111 of each second blade 311*c*, i.e., the first impeller side or the air-inlet side edge of each second blade 311*c* are inclined with respect to the radial direction such that they get closer to the air-outlet side end of the axial fan unit 1*c* as they move away from the center axis J1.

Between the first and second impellers 21 and 31, the first rib edge 241 of each first rib 24*c*, i.e., the first impeller side or the air-inlet side edge of each first rib 24*c* is inclined with respect to the radial direction such that it gets closer to the air-outlet side end of the axial fan unit 1*c* as it moves away from the center axis J1. Similarly, the second rib edge 241 of each first rib 24*c*, i.e., the second impeller side or the air-outlet side edge thereof is inclined with respect to the radial direction such that it gets close to the air-outlet side end of the axial fan unit 1*c* as it moves away from the center axis J1. The axial distance between the first rib edges 241 and the first envelope obtained by turning the first blade edges 2111 about the center axis J1 and the axial distance between the second rib edges 242 and the second envelope obtained by turning the second blade edges 3111 about the center axis J1 are approximately constant and are approximately equal to each other.

On the air-outlet side of the second impeller 31, the third blade edge 3112 of each second blade 311*c*, which is the air-outlet side or the opposite side to the first impeller 21, is inclined with respect to the radial direction. The third blade edge 3112 is inclined such that it gets closer to the air-outlet side end of the axial fan unit 1*c* as it moves away from the center axis J1. The third rib edge 341 of each second rib 34*c*, i.e., the second impeller side edge or the air-inlet side edge thereof, is inclined with respect to the radial direction such that it gets closer to the air-outlet side end of the axial fan unit 1*c* as it moves away from the center axis J1. The third rib edges 341 extend along the third envelope with an approximately constant gap kept therebetween.

With this configuration, interference of air sent from the first blades 211*c* with the first ribs 24*c* can be suppressed, as in the first through third preferred embodiments. Thus, it is possible to reduce noises of the axial fan unit 1*c*. Moreover, interference of air flowing into the second blades 311*c* with the first ribs 24*c* can be also suppressed. Thus, the noises of the axial fan unit 1*c* can be further reduced. Furthermore, interference of air sent by the second blades 311*c* with the second ribs 34*c* can be suppressed, thus further reducing the noises of the axial fan unit 1*c*.

Fifth Preferred Embodiment

Figure 11:
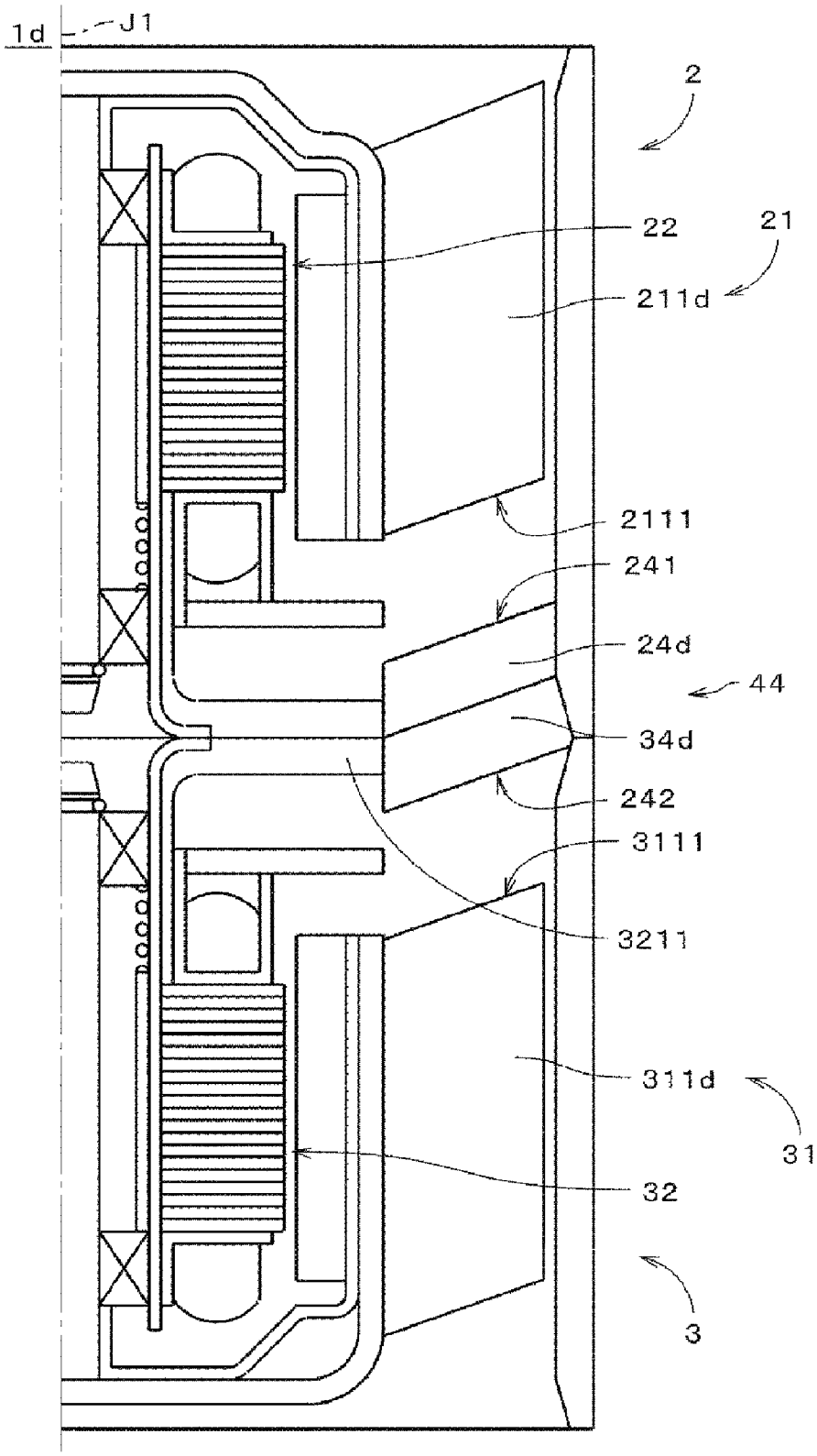
FIG. 11 is a cross-sectional view of a portion of an axial fan unit according to a fifth preferred embodiment of the present invention.

An axial fan unit according to a fifth preferred embodiment of the present invention is now described. FIG. 11 is a cross-sectional view of the axial fan unit 1*d* of the fifth preferred embodiment. As shown in FIG. 11, the axial fan unit 1*d* includes the second axial fan 3 which is turned upside down and is disposed on the air-outlet side of the first axial fan 2.

Referring to FIG. 11, the base portion 3211 of the second motor 32 of the second axial fan 3 is disposed on the first impeller side (the air-inlet side) of the second impeller 31. A plurality of second ribs 34*d* are disposed on the second impeller side (the air-outlet side) of a plurality of first ribs 24*d* of the first axial fan 2. In this preferred embodiment, the number of the second ribs 34*d* and the number of the first ribs 24*d* are the same as each other. For example, three first ribs 24*d* and three second ribs 34*d* are disposed. When seen in the axial direction, one of the first rib 24*d* and the corresponding second rib 34*d* are laid over the other over its entire length. The first rib 24*d* and its corresponding second rib 34*d* define a rib 44. That is, the first and second motors 22 and 32 are supported axially between the first and second impellers 21 and 31 with a plurality of ribs 44 each defined by the first rib 24*d* and the second rib 34*d*.

The first impeller side edge 241 and the second impeller side edge 242 of each rib 44, which are referred to as the first rib edge 241 and the second rib edge 242 are inclined with respect to the radial direction such that they get closer to the air-inlet side end of the axial fan unit 1*d* as they move away from the center axis J1. Please note that the first rib edge 241 and the second rib edge 242 of the rib 44 are the air-inlet side edge of the first rib 24 and the air-outlet side edge of the second rib 34*d*, respectively. Similarly, the first blade edge 2111 of each first blade 211*d*, which is the second impeller side edge thereof, and the second blade edge 3111 of each second blade 311*d*, which is the first impeller side edge thereof are inclined with respect to the radial direction such that they get closer to the air-inlet side end of the axial fan unit 1*d* as they move away from the center axis J1. An axial distance between the first rib edges 241 and the first envelope and an axial distance between the second rib edges 242 and the second envelope are approximately constant and are approximately equal to each other.

In the axial fan unit 1*d* of this preferred embodiment, interference of air sent by the first blades 211*d* and air flowing into the second blades 311*d* with the ribs 44 can be suppressed. Thus, noises of the axial fan unit 1*d* can be reduced as in the first preferred embodiment.

Moreover, in the axial fan unit 1*d*, an axial distance between the first and second impellers 21 and 31 can be set to be larger as compared with that in the aforementioned preferred embodiments, especially because the first and second ribs 24*d* and 34*d* are disposed between the first and second impellers 21 and 31. Thus, interference of air from the first blades 211*d* with the second blades 311*d* can be suppressed, resulting in reduction in the noises of the axial fan unit 1*d*. In addition, one of the first ribs 24*d* and the second ribs 34*d* are laid over the other when seen in the axial direction. Therefore, interference of air from the first blades 211*d* with the ribs 44 (especially the second ribs 34*d*) can be suppressed. Therefore, the noises of the axial fan unit 1*d* can be further reduced.

Sixth Preferred Embodiment

Figure 12:
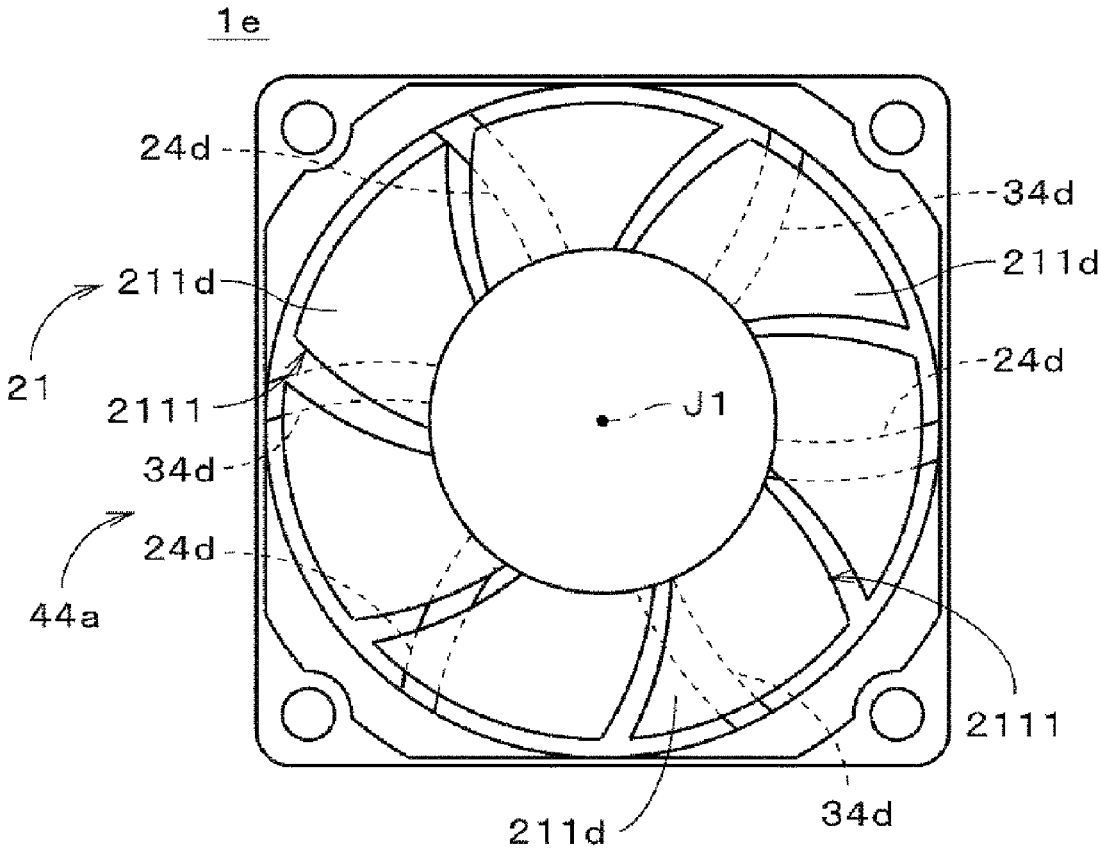
FIG. 12 is a cross-sectional view of a portion of an axial fan unit according to a sixth preferred embodiment of the present invention.

An axial fan unit according to a sixth preferred embodiment of the present invention is now described. FIG. 12 is a plan view of the axial fan unit 1*e* of the sixth preferred embodiment when seen from its air-inlet side. As shown in FIG. 12, no first rib 24*d* is laid over the second rib 34. That is, the first ribs 24*d* are located between the second ribs 34 when seen in the axial direction. Except for this point, the axial fan unit 1*e* preferably has substantially the same structure as the axial fan unit 1*d* of the fifth preferred embodiment shown in FIG. 11. Therefore, components of the axial fan unit 1*e* that are the same as those of the axial fan unit 1*d* are labeled with the same reference numerals as those in FIG. 11. In the following description, the first ribs 24*d* and the second ribs 34*d* are collectively referred to as ribs 44*a*. In the axial fan unit 1*e*, the ribs 33*a* are disposed about the center axis J1 at regular angular intervals. In this preferred embodiment, six ribs 44*a* (three first ribs 24*d* and three second ribs 34*d*), for example, are preferably disposed about the center axis J1 at an angular interval of about 60 degrees.

As shown in FIG. 11, the first rib edge 241 of the rib 44*a* (the air-inlet side edge of the first rib 24*d*) and the second rib edge 242 of the rib 44*a* (the air-outlet side edge of the second rib 34*d*) are inclined with respect to the radial direction such that they get closer to the air-inlet side end of the axial fan unit 1*e* as they move away from the center axis J1. Similarly, the first blade edge 2111 of the first blade 211*d* and the second blade edge 3111 of the second blade 311*d* are inclined with respect to the radial direction such that they get closer to the air-inlet side end of the axial fan unit 1*e* as they move away from the center axis J1, as shown in FIG. 11. Moreover, an axial distance between the first rib edges 241 and the first envelope and an axial distance between the second rib edges 2442 and the second envelope are approximately constant and are approximately equal to each other.

In the axial fan unit 1*e*, interference of air sent from the first blades 211*d* and air flowing into the second blades 311*d* (see FIG. 11) with the ribs 44*a* can be suppressed. Thus, noises of the axial fan unit 1*e* can be reduced as in the fifth preferred embodiment. Moreover, when the axial fan unit 1*e* of this preferred embodiment is seen in the axial direction, the first and second ribs 24*d* and 34*d* are disposed between the first and second impellers 21 and 31 (see FIG. 11). This arrangement contributes to further reduction in the noises of the axial fan unit 1*e*.

Seventh Preferred Embodiment

Figure 13:
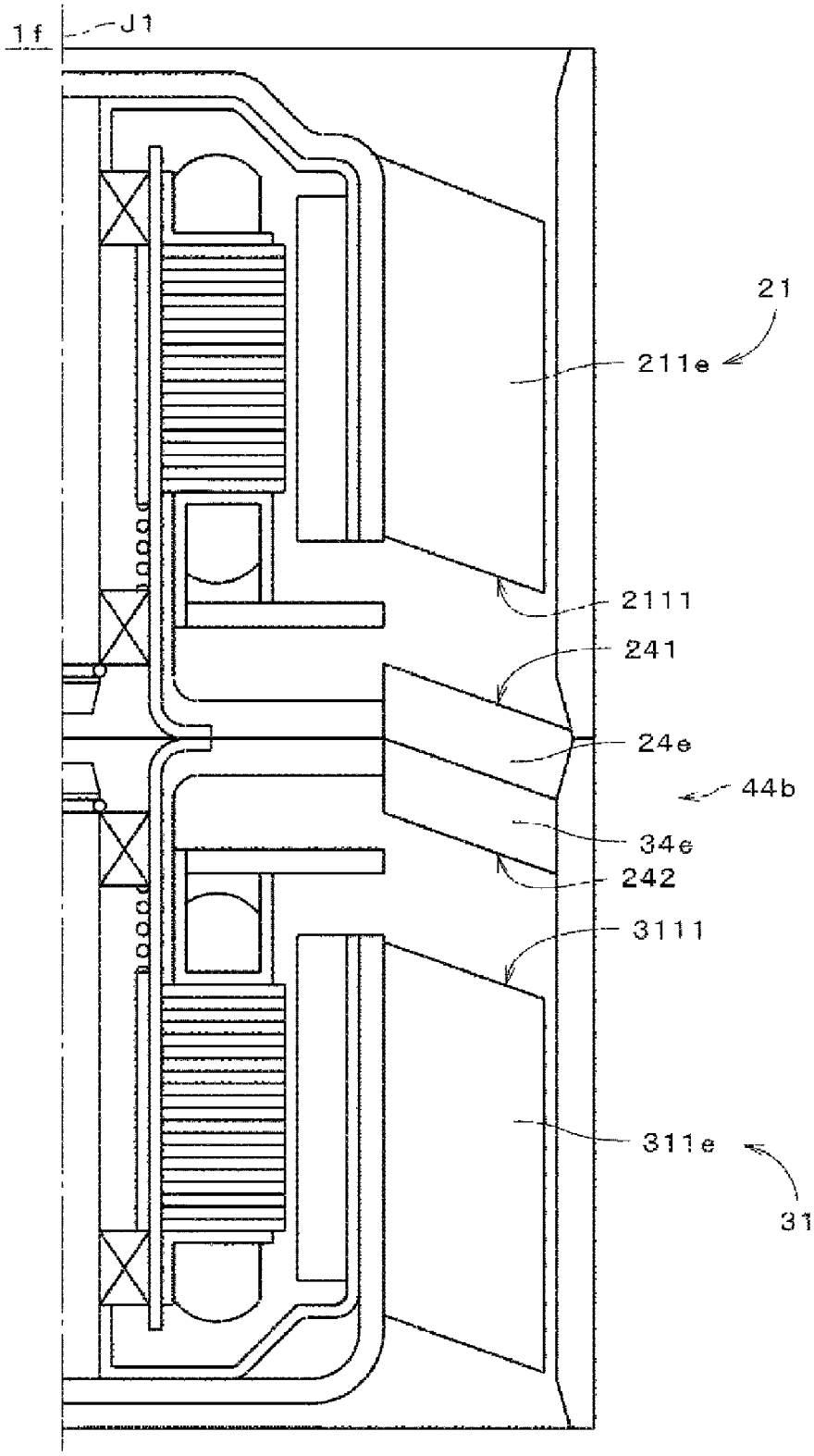
FIG. 13 is a cross-sectional view of a portion of an axial fan unit according to a seventh preferred embodiment of the present invention.

An axial fan unit according to a seventh preferred embodiment of the present invention is now described. FIG. 13 is a cross-sectional view of a portion of the axial fan unit 1*f* of the seventh preferred embodiment. As shown in FIG. 13, the axial fan unit if includes first blades 211*e* and second blades 311*e* which are different in the shape of blade edges from the first blades 211*d* and the second blades 311*d* of the axial fan unit 1*d* of the fifth preferred embodiment shown in FIG. 11. Also, the first and second ribs 24*d* and 34*d* of the axial fan unit 1*d* of the fifth preferred embodiment are replaced with first and second ribs 24*e* and 34*e* which are different in the shape of rib edges from the first and second ribs 24*d* and 34*d*, respectively. Except for the above, the axial fan unit 1*f* preferably has substantially the same structure as the axial fan unit 1*d* of the fifth preferred embodiment shown in FIG. 11. Therefore, like components are given like reference numerals in the following description. Please note that the first and second ribs 24*e* and 34*e* may be collectively referred to as "ribs 44*b*".

Referring to FIG. 13, the first blade edges 2111 of the first blades 211*e* of the first impeller 21 and the second blade edges 3111 of the second blades 311*e* of the second impeller 31 are inclined with respect to the radial direction such that they get closer to the air-outlet side end of the axial fan unit 1*f* as they move away from the center axis J1. Similarly, the first rib edges 241 of the ribs 44*b*, which are the air-inlet side edges of the first ribs 24*e*, and the second rib edges 242, which are the air-outlet side edges of the second ribs 34*e*, are inclined with respect to the radial direction such that they get closer to the air-outlet side end of the axial fan unit 1*f* as they move away from the center axis J1. An axial distance between the first rib edges 241 and the first envelope and an axial distance between the second rib edges 242 and the second envelope are approximately constant and are approximately equal to each other.

In the axial fan unit 1*f*, interference of air sent by the second blades 211*e* and air flowing into the second blades 311*e* with the ribs 44*b* are suppressed. Thus, noises of the axial fan unit 1*f* of this preferred embodiment can be reduced as in the fifth preferred embodiment.

Eighth Preferred Embodiment

Figure 14:
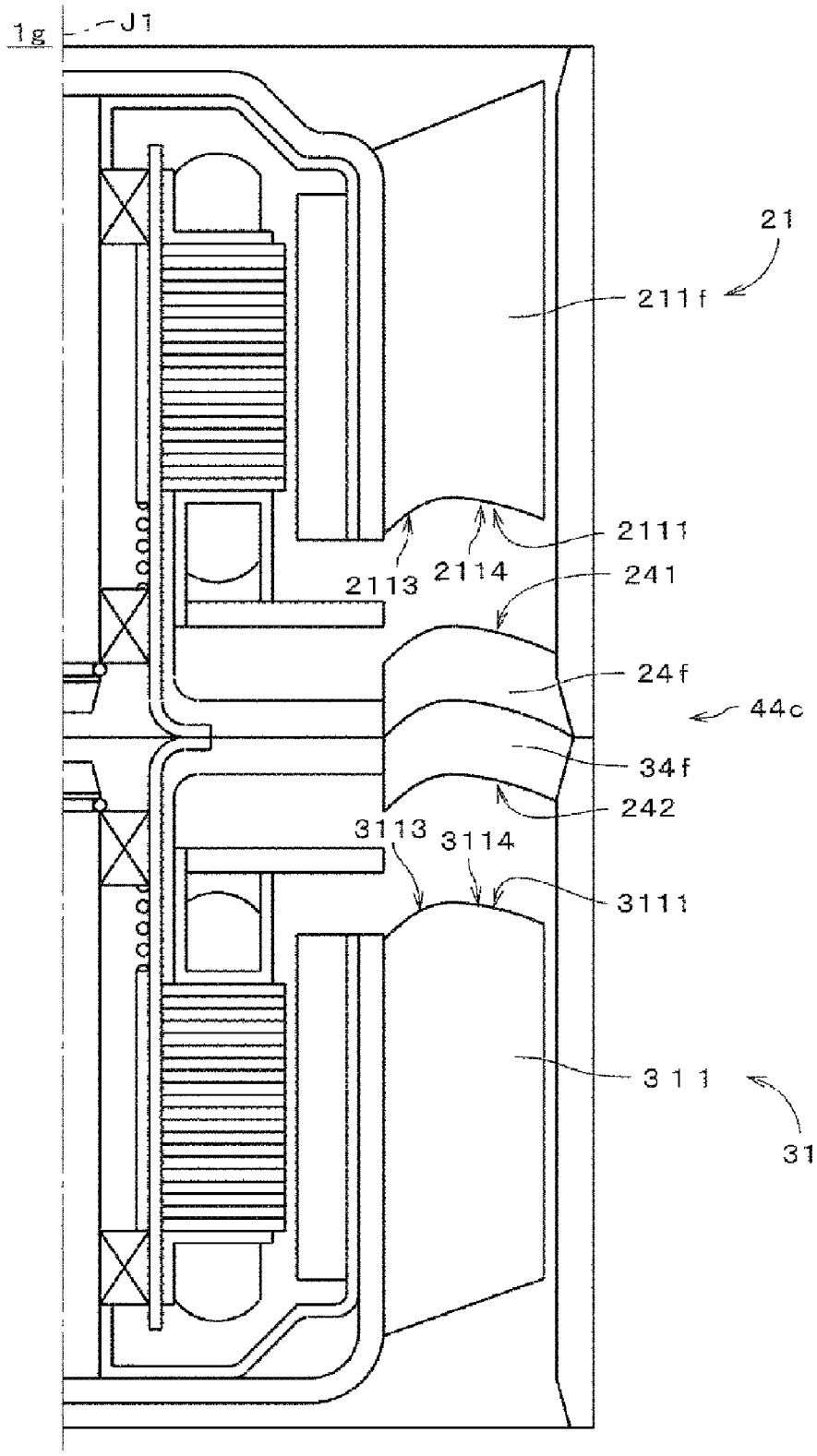
FIG. 14 is a cross-sectional view of a portion of an axial fan unit according to an eighth preferred embodiment of the present invention.

An axial fan unit according to an eighth preferred embodiment of the present invention is now described. FIG. 14 is a cross-sectional view of a portion of the axial fan unit 1*g* of the eighth preferred embodiment. As shown in FIG. 14, the axial fan unit 1*g* includes first and second blades 211*f* and 311*f* which are different in the shape of blade edges from the first and second blades 211*d* and 311*d* of the axial fan unit 1*d* of the fifth preferred embodiment shown in FIG. 11, and also includes first and second ribs 24*f* and 34*f* which are different in the rib edges from the first and second ribs 24*d* and 34*d* of the axial fan unit 1*d*. Except for the above, the axial fan unit 1*g* of this preferred embodiment preferably has substantially the same structure as the axial fan unit 1*d* of the fifth preferred embodiment shown in FIG. 11. Therefore, like parts are given like reference numerals in the following description.

In the axial fan unit 1*g*, the number of the second ribs 34*f* is the same as the number of the first ribs 24*f* and the second ribs 34*f* are disposed on the second impeller side (the air-outlet side) of the first ribs 24*f*, as in the fifth preferred embodiment. Each first rib 24*f* is laid over a corresponding one of the second ribs 34*f* over its entire length, when seen in the axial direction. In the following description, the first and second ribs 24*f* and 34*f* are collectively referred to as ribs 44*c*.

Referring to FIG. 14, in the axial fan unit 1*g*, the first blade edge 2111 of each first blade 211*f* of the first impeller 21, which is the air-outlet side edge thereof, includes an inclined portion 2113 and an inclined portion 2114 which are inclined with respect to the radial direction, as in the axial fan unit 1*a* shown in FIG. 8. Similarly, the second blade edge 3111 of each second blade 311*f* of the second impeller 31, which is the air-inlet side edge thereof, includes an inclined portion 3113 and an inclined portion 3114 which are inclined with respect to the radial direction.

The air-inlet side edges of the first ribs 24*f*, i.e., the first rib edges 241 of the ribs 44*c* extend along the first envelope obtained by turning the first blade edges 2111 about the center axis J1 with a gap kept between the first envelope and the first rib edges 241. Similarly, the air-outlet side edges of the second ribs 34*f*, i.e., the second rib edges 242 of the ribs 44*c* extend along the second envelope obtained by turning the second blade edges 3111 about the center axis J1 with a gap kept between the second envelope and the second rib edges 242. Moreover, at any position on each rib 44*c* in the radial direction, an axial distance between the first rib edges 241 and the first envelope and an axial distance between the second rib edges 242 and the second envelope are approximately constant and approximately equal to each other.

In the axial fan unit 1*g* of this preferred embodiment, the first rib edges 241 of the ribs 44*c* extend along the first blade edges 2111 of the first blades 211*f*, while the second rib edges 242 of the ribs 44*c* extend along the second blade edges 3111 of the second blades 311*f*. With this configuration, interference of air flowing into the second blades 311*f* with the ribs 44*c* are suppressed, reducing noises of the axial fan unit 1*g*, as in the second preferred embodiment.

Ninth Preferred Embodiment

An axial fan unit according to a ninth preferred embodiment of the present invention is now described. The axial fan unit of the ninth preferred embodiment preferably has substantially the same structure as the axial fan unit 1*g* of the eighth preferred embodiment shown in FIG. 14, except that the first ribs are disposed between the second ribs when seen in the axial direction, as in the axial fan unit 1*e* shown in FIG. 12. With this configuration, noises of the axial fan unit of this preferred embodiment can be suppressed as in the eighth preferred embodiment.

The first through ninth preferred embodiments of the present invention are described above. However, the present invention is not limited thereto but can be modified in various ways.

For example, in the axial fan unit 1 of the first preferred embodiment, the air-outlet side edges 3112 of the second blades 311, i.e., the third blade edges 3112 and the air-inlet side edges of the second ribs 34, i.e., the third rib edges 341 may be inclined with respect to the radial direction such that they get closer to the air-outlet side end of the axial fan unit 1 as they move away from the center axis J1. In other words, the first blade edges 2111, the first rib edges 241, the second rib edges 242, and the second blade edges 3111 get closer to one axial end of the axial fan unit while the third blade edges 3112 and the third rib edges 341 get closer to the other axial end of the axial fan unit, as they move away from the center axis J1.

Figure 15:
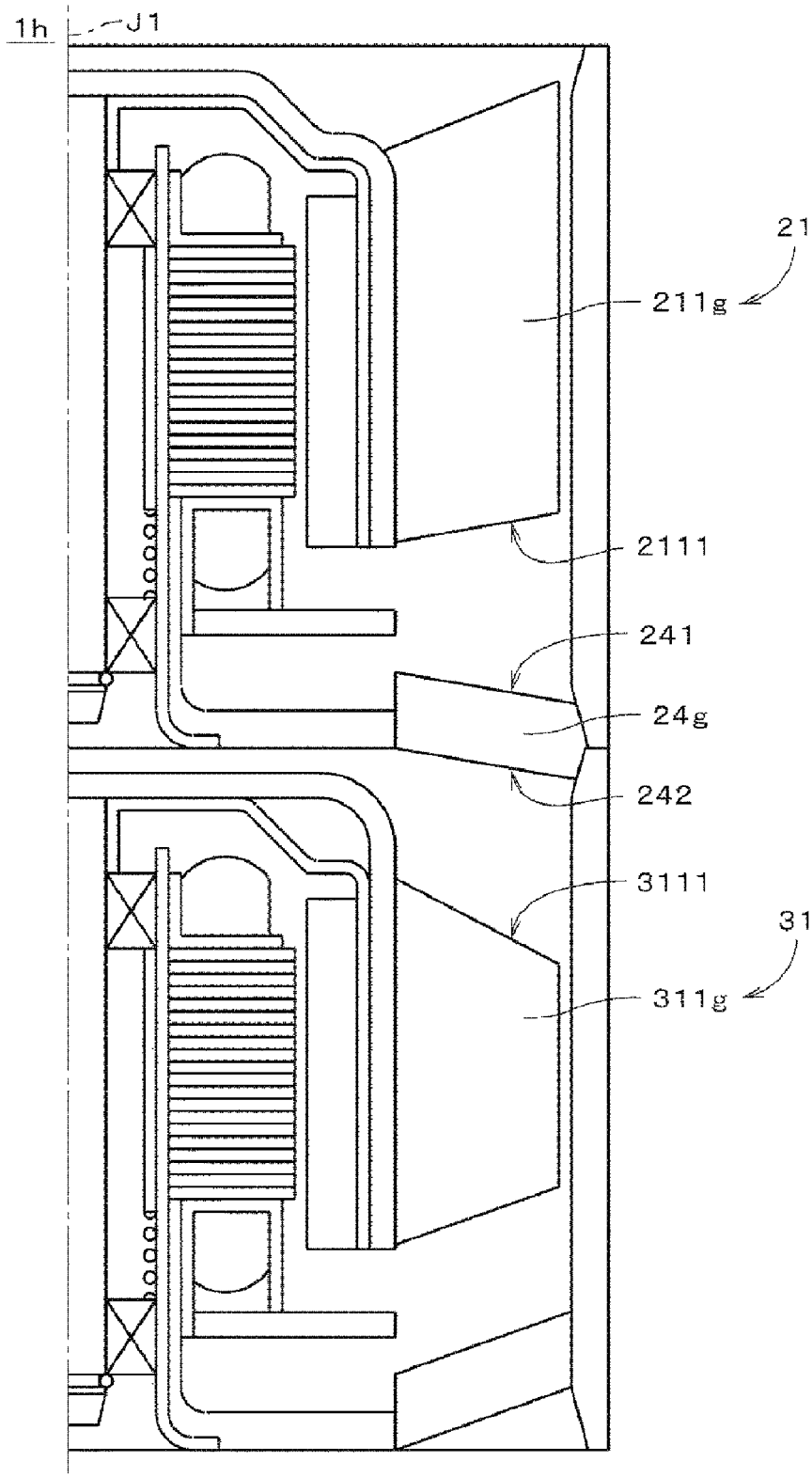
FIG. 15 is across-sectional view of another exemplary axial fan unit according to preferred embodiments of the present invention.

FIG. 15 shows another exemplary axial fan unit 1*h*. In the axial fan unit 1*h*, the first blade edges 2111 of the first blades 211*g* get closer to the air-inlet side end of the axial fan unit 1*h* and the second blade edges 3111 of the second blades 311*g* get closer to the air-outlet side end of the axial fan unit 1*h*, as they move away from the center axis J1. The first rib edges 24*a* and the second rib edges 242 of the first ribs 24*g* are inclined with respect to the radial direction such that they get closer to the air-outlet side end of the axial fan unit 1*h* as they move away from the center axis J1. At any position on each first rib 24*g* in the radial direction, an axial distance between the first rib edges 241 and the first envelope and an axial distance between the second rib edges 242 and the second envelope are substantially equal to each other. As described above, even if the inclination direction of the first rib edges 241 of the first ribs 24*g* with respect to the radial direction is opposite to the inclination direction of the first blade edges 2111 of the first blades 211*g*, interference of air from the first blades 211*g* with the first ribs 24*g* can be suppressed. Thus, noises of the axial fan unit 1*h* can be reduced. Please note that the first blade edges 2111 are not necessarily inclined with respect to the radial direction but may extend perpendicularly or substantially perpendicularly to the center axis J1.

In the axial fan unit 1*d* of the fifth preferred embodiment, it is not necessary that each first rib 24*d* is laid over a corresponding second rib 34*d*. It is enough that at least a portion of the first rib 24*d* is laid over a corresponding second rib 34*d* in the radial direction. This is the same in the seventh and eighth preferred embodiments.

In the axial fan units of the aforementioned preferred embodiments, a member in which a cross section perpendicular to the radial direction is blade-like, i.e., a so-called stator vane, may be provided as the first rib. In this case, the first rib has a stator function of suppressing spreading of air sent from the first impeller 21 away from the center axis J1. This is the same for the second ribs.

In the axial fan unit 1*e* of the sixth preferred embodiment, the first and second ribs 24*d* and 34*d* are not necessarily disposed about the center axis J1 at regular angular intervals. Instead, the first and second ribs 24*d* and 34*d* may be disposed at non-regular intervals which are appropriately determined to reduce the noises of the axial fan unit 1*e*. This is the same for the ninth preferred embodiment.

In the axial fan units of the aforementioned preferred embodiments, the number of the first ribs is equal to the number of the second ribs. However, the number of the first ribs is different from the number of the second ribs. For example, three first ribs are disposed on the air-outlet side of the first impeller 21, while four second ribs are disposed on the air-outlet side of the second impeller 31. Moreover, the first and second housing pieces 23 and 33 may be replaced with a single hollow housing which is disposed radially outside the first and second impellers 21 and 31 and radially surrounds them, if necessary.

In the axial fan units of the aforementioned preferred embodiments, the first impeller 21 of the first axial fan 2 and the second impeller 31 of the second axial fan 3 may rotate in the same direction as each other. Moreover, air may be taken from the second axial fan side and be discharged from the first axial fan side by changing the blade shapes of the blades, the arrangement of the blades, and the rotating directions of the impellers, and the like. Furthermore, the axial fan units of the aforementioned preferred embodiments may be modified to include at least one axial fan in addition to the first and second axial fans 2 and 3 such that all the axial fans are disposed coaxially with each other.

As described above, according to the preferred embodiments of the present invention, noises of an axial fan unit can be significantly reduced and minimized.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An axial fan unit comprising:

a first impeller including a plurality of first blades which are disposed about a center axis;

a first motor operable to rotate the first impeller about the center axis to create a first flow of air generally flowing along the center axis;

a second impeller adjacent to the first impeller and including a plurality of second blades disposed about the center axis;

a second motor operable to rotate the second impeller about the center axis to create a second flow of air flowing generally in a direction of the first flow of air;

a housing arranged to surround the first impeller and the second impeller; and a plurality of ribs disposed between the first impeller and the second impeller and connected at least to the housing and the first motor; wherein first impeller side edges of the plurality of ribs and second impeller side edges of the plurality of ribs are both inclined with respect to a radial direction that is perpendicular or substantially perpendicular to the center axis; and the second impeller side edges of the plurality of ribs and first impeller side edges of the plurality of second blades are arranged at identical angles such that an axial distance between the second impeller side edges of the plurality of ribs and the first impeller side edges of the plurality of second blades remains constant.

2. The axial fan unit according to claim 1, wherein second impeller side edges of the plurality of first blades are inclined with respect to the radial direction to get closer to one of axial ends of the axial fan unit as the second impeller side edges move away from the center axis.

3. The axial fan unit according to claim 2, wherein the first impeller side edges of the plurality of ribs get closer to the one axial end of the axial fan unit as the first impeller side edges move away from the center axis.

4. The axial fan unit according to claim 2, wherein the first impeller side edges of the plurality of ribs get closer to the other axial end of the axial fan unit as the first impeller side edges move away from the center axis.

5. The axial fan unit according to claim 3, wherein the first impeller side edges of the plurality of ribs extend along an envelope obtained by turning the second impeller side edges of the plurality of first blades about the center axis with an axial distance between the envelope and the second impeller side edges of the plurality of first blades kept approximately constant.

6. The axial fan unit according to claim 3, wherein the first impeller side edges of the plurality of ribs extend along an envelope obtained by turning the second impeller side edges of the plurality of first blades about the center axis with a shortest distance between the envelope and the second impeller side edges of the plurality of first blades kept approximately constant.

7. The axial fan unit according to claim 3, wherein the first impeller side edges of the plurality of second blades and the second impeller side edges of the plurality of ribs are inclined with respect to the radial direction and get closer to the one axial end of the axial fan unit.

8. The axial fan unit according to claim 1, wherein, at any position on each of the plurality of ribs in the radial direction, an axial distance between the first impeller side edges of the plurality of ribs and a first envelope obtained by turning the second impeller side edges of the plurality of first blades about the center axis is approximately equal to an axial distance between the second impeller side edges of the plurality of ribs and a second envelope obtained by turning the first impeller side edges of the plurality of second blades about the center axis.

9. The axial fan unit according to claim 1, further comprising second ribs different from the plurality of ribs, wherein the second ribs are disposed about the center axis on an opposite side of the second impeller to the first impeller and are connected to the housing and the second motor.

10. The axial fan unit according to claim 9, wherein the housing includes a first housing piece surrounding the first impeller and a second housing piece surrounding the second impeller, the plurality of ribs and the second ribs being connected to the first and second housing pieces, respectively.

11. The axial fan unit according to claim 9, wherein other edges of the plurality of second blades, which are on an opposite side of the plurality of second blades to the first impeller, and second impeller side edges of the second ribs are inclined with respect to the radial direction toward the one axial end of the axial fan unit.

12. The axial fan unit according to claim 1, wherein the plurality of ribs include a plurality of first ribs and a plurality of second ribs, the plurality of first ribs are disposed about the center axis and connected to the first motor and the housing, and the plurality of second ribs are disposed about the center axis on a second impeller side of the plurality of first ribs and connected to the second motor and the housing.

13. The axial fan unit according to claim 12, wherein the number of the plurality of first ribs is the same as the number of the plurality of second ribs, and each of one of the plurality of first ribs and the plurality of second ribs is laid over a corresponding one of the other of the plurality of first ribs and the plurality of second ribs at least partially when viewed along the center axis.

14. The axial fan unit according to claim 12, wherein the number of the plurality of first ribs is the same as the number of the plurality of second ribs, and the plurality of first ribs are located between the plurality of second ribs, when viewed along the center axis.

15. An axial fan unit comprising:

a first impeller including a plurality of first blades disposed about a center axis;

a first motor operable to rotate the first impeller about the center axis to create a first flow of air generally flowing along the center axis;

a second impeller adjacent to the first impeller along the center axis and including a plurality of second blades disposed about the center axis;

a second motor operable to rotate the second impeller about the center axis to create a second flow of air generally flowing in the same direction as the first flow;

a housing arranged to surround the first and second impellers; and a plurality of ribs disposed about the center axis between the first and second impellers and connected at least to the housing and the first motor; wherein second impeller side edges of the plurality of first blades include inclined portions which are inclined with respect to a radial direction that is perpendicular or substantially perpendicular to the center axis;

first impeller side edges of the plurality of second blades include inclined portions which are inclined with respect to the radial direction that is perpendicular or substantially perpendicular to the center axis;

first impeller side edges of the plurality of ribs extend along an envelope obtained by turning the second impeller side edges of the plurality of first blades about the center axis with a gap kept between the first impeller side edges of the plurality of ribs and the envelope;

second impeller side edges of the plurality of ribs and the first impeller side edges of the plurality of second blades are arranged at identical angles such that an axial distance between the second impeller side edges of the plurality of ribs and the first impeller side edges of the plurality of second blades remains constant.

16. The axial fan unit according to claim 15, wherein each of first impeller side edges of the plurality of second blades includes an inclined portion which is inclined with respect to the radial direction, and second impeller side edges of the plurality of ribs extend along another envelope obtained by turning the first impeller side edges of the plurality of second blades about the center axis with a gap kept between the second impeller side edges of the plurality of ribs and the other envelope.

17. The axial fan unit according to claim 15, further comprising second ribs which are different from the plurality of ribs, wherein the second ribs are disposed about the center axis on an opposite side of the second impeller to the first impeller and are connected to the housing and the second motor.

18. The axial fan unit according to claim 15, wherein the plurality of ribs include a plurality of first ribs and a plurality of second ribs, both of which are disposed about the center axis, the plurality of first ribs being connected to the housing and the first motor, the plurality of second ribs being connected to the housing and the second motor.

19. The axial fan unit according to claim 18, wherein the number of the plurality of first ribs is equal to the number of the plurality of second ribs, and each of the plurality of first ribs is laid over any one of the plurality of second ribs at least partially when viewed along the center axis.

20. The axial fan unit according to claim 17, wherein the number of the plurality of first ribs is equal to the number of the plurality of second ribs, and the plurality of first ribs are located between the plurality of second ribs when seen along the center axis.

21. The axial fan unit according to claim 18, wherein the housing includes first and second housing pieces arranged to surround the first and second impellers, respectively, and the plurality of first ribs and the plurality of second ribs are connected to the first and second housing pieces, respectively.

22. The axial fan unit according to claim 12, wherein the plurality of first ribs are arranged to curve in a first circumferential direction and the plurality of second ribs are arranged to curve in a second circumferential direction, the first circumferential direction being opposite to the second circumferential direction.

23. The axial fan unit according to claim 18, wherein the plurality of first ribs are arranged to curve in a first circumferential direction and the plurality of second ribs are arranged to curve in a second circumferential direction, the first circumferential direction being opposite to the second circumferential direction.

24. The axial fan unit according to claim 1, wherein an axial distance between the first impeller side edges of the plurality of ribs and second impeller side edges of the plurality of first blades is identical to the axial distance between the second impeller side edges of the plurality of ribs and the first impeller side edges of the plurality of second blades.

25. The axial fan unit according to claim 15, wherein an axial distance of the gap is identical to the axial distance between the second impeller side edges of the plurality of ribs and the first impeller side edges of the plurality of second blades.

* * * * *